US012366243B1

(12) United States Patent
Stephenson et al.

(10) Patent No.: US 12,366,243 B1
(45) Date of Patent: Jul. 22, 2025

(54) MINIMIZING DRIVETRAIN DAMAGE FROM BAD DISCHARGE VALVES ON POSITIVE DISPLACEMENT PUMPS

(71) Applicant: Halliburton Energy Services, Inc., Houston, TX (US)

(72) Inventors: Stanley Vernon Stephenson, Duncan, OK (US); David Rand Hill, Zanesville, OH (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/423,653

(22) Filed: Jan. 26, 2024

(51) Int. Cl.

| | |
|---|---|
| ***F04B 51/00*** | (2006.01) |
| ***E21B 43/26*** | (2006.01) |
| ***E21B 47/008*** | (2012.01) |
| ***F04B 15/02*** | (2006.01) |
| ***F04B 17/03*** | (2006.01) |
| ***F04B 17/05*** | (2006.01) |

(Continued)

(52) U.S. Cl.
CPC ..... *F04B 51/00* (2013.01); *E21B 43/26* (2013.01); *E21B 43/2607* (2020.05); *E21B 47/008* (2020.05); *F04B 15/02* (2013.01); *F04B 17/03* (2013.01); *F04B 17/05* (2013.01); *F04B 47/02* (2013.01); *F04B 49/06* (2013.01); *F04B 49/065* (2013.01); *F04B 49/20* (2013.01)

(58) Field of Classification Search
CPC .. E21B 43/2607; E21B 43/26; E21B 2200/20; E21B 47/008; F04B 49/065; F04B 51/00; F04B 47/02; F04B 15/02; F04B 17/05; F04B 17/03; F04B 49/20; F04B 49/06
See application file for complete search history.

(56) References Cited

U.S. PATENT DOCUMENTS

| | | |
|---|---|---|
| 8,366,402 B2 | 2/2013 | St. Michel et al. |
| 9,341,055 B2 | 5/2016 | Weightman et al. |

(Continued)

OTHER PUBLICATIONS

Filing Receipt, Specification and Drawings for U.S. Appl. No. 18/385,125, filed Oct. 28, 2023, entitled "Drive Power Based Pump Monitoring," 68 pages.

(Continued)

*Primary Examiner* — Peter J Bertheaud
(74) *Attorney, Agent, or Firm* — Conley Rose, P.C.; Rodney B. Carroll

(57) ABSTRACT

A pumping system, comprising: a pump fluid end comprising a plurality of pump chambers, each pump chamber comprising a bore having a reciprocatable plunger disposed therein, a suction valve, and a discharge valve; a prime mover mechanically coupled to the fluid end [by a drivetrain] and configured to reciprocate the plungers; and a controller communicatively coupled to the prime mover, the fluid end, or both and configured to alert a user re a pump malfunction, initiate corrective action of the pump malfunction, or both in response to: (a) an indication of torque reversal during operation of the pumping system, (b) an indication of negative flow rate from the pump during operation of the pumping system, (c) an indication of leakage of (i) a single discharge valve in a 3-plunger pump or (ii) discharge valves associated with two plungers in adjacent firing order, or (d) any combination of (a)-(c).

20 Claims, 11 Drawing Sheets

(51) Int. Cl.

| | |
|---|---|
| ***F04B 47/02*** | (2006.01) |
| ***F04B 49/06*** | (2006.01) |
| ***F04B 49/20*** | (2006.01) |

(56) References Cited

U.S. PATENT DOCUMENTS

| | | | | |
|---|---|---|---|---|
| 9,631,616 | B2 * | 4/2017 | Trump | G01N 35/1016 |
| 10,415,562 | B2 * | 9/2019 | Kajita | F04B 49/06 |
| 10,895,254 | B2 | 1/2021 | Beisel | |
| 10,927,831 | B2 | 2/2021 | Beisel | |
| 10,995,594 | B2 | 5/2021 | Beisel | |
| 11,022,526 | B1 | 6/2021 | Yeung et al. | |
| 11,028,845 | B2 | 6/2021 | Beisel | |
| 11,441,557 | B2 | 9/2022 | Beisel | |
| 11,499,544 | B2 | 11/2022 | Beisel | |
| 11,499,547 | B2 | 11/2022 | Zhang et al. | |
| 2023/0340954 | A1 * | 10/2023 | Bolt | F04B 51/00 |

OTHER PUBLICATIONS

Caroline Day et al., "EU Guidelines for Patenting AI and Machine Learning Technologies: Comparison With U.S. Approach." Navigating EPO and USPTO Rules to Maximize Patent Protection, Oct. 5, 2023. Strafford.

Halliburton, Q10™ Pumping Unit, High Pressure Pumping Technology, H09160 04/12 pp. 1-2.

* cited by examiner

MINIMIZING DRIVETRAIN DAMAGE FROM BAD DISCHARGE VALVES ON POSITIVE DISPLACEMENT PUMPS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD

This application relates to systems and methods for minimizing drivetrain damage resulting from one or more damaged discharge valves on positive displacement pumps used to pump a treatment fluid into a wellbore penetrating a subterranean formation.

BACKGROUND

Hydraulic fracturing operations may include a number of high pressure pumps directing proppant laden fluid into a hydrocarbon bearing formation. The proppant laden fluid must be pumped at pressure into subterranean formations to produce fractures and provide a flow path for production of desired hydrocarbons such as oil and gas. The pressures, flowrates, and concentration of the proppant laden fluids must be controlled, typically with multiple pumps, to achieve the intended effect. Due to the high-stress nature of the pumping operation, high pressure pump parts may undergo mechanical wear and require frequent replacement. Failure of one or more pump parts may lead to an undesirable decrease in pumping performance during a pumping operation. An improved system and method of monitoring the health of the high pressure pumps during the pumping operation is desirable.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
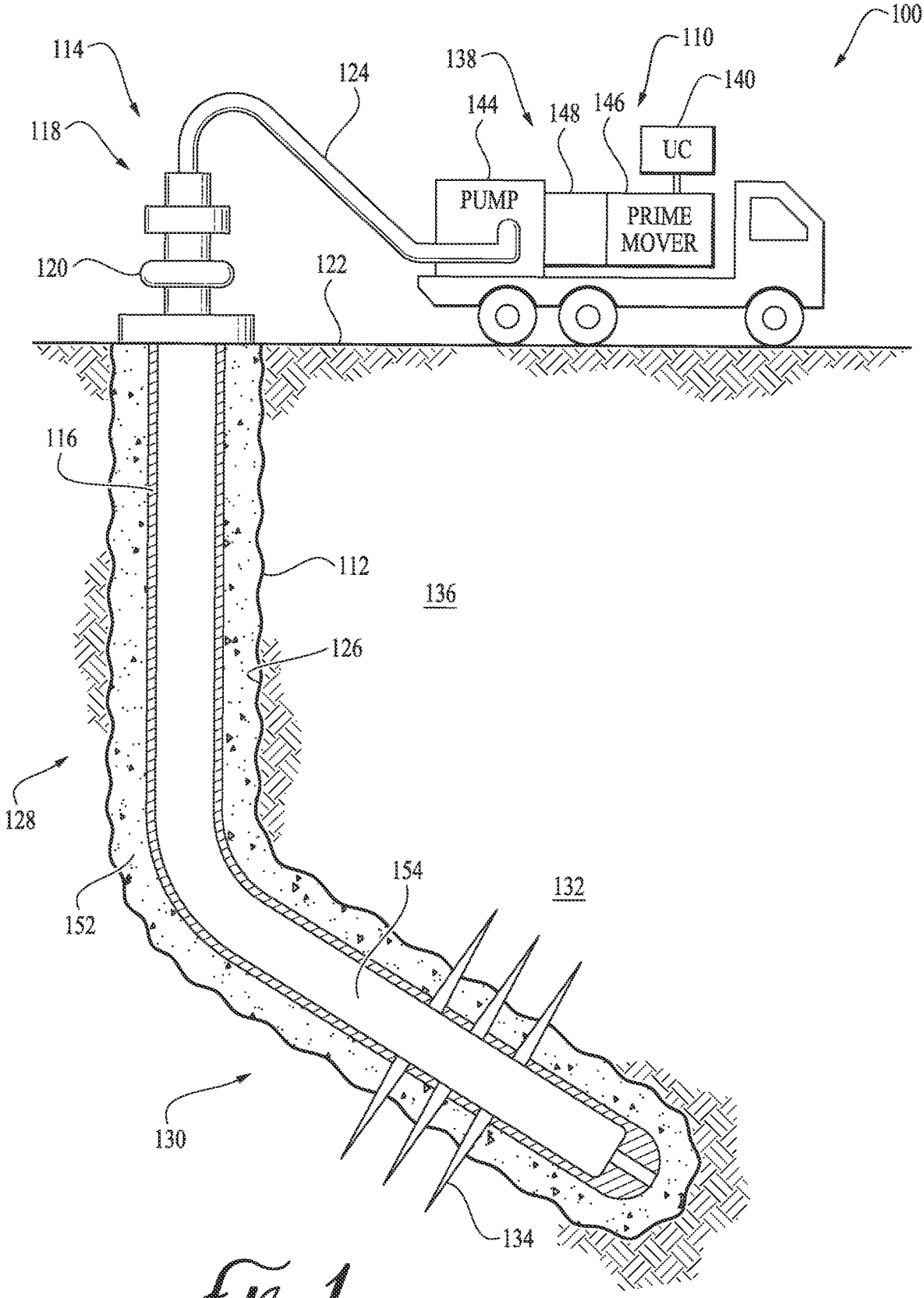
FIG. 1 is a partial cross-sectional view of a pumping operation environment at a wellsite according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, a pumping unit can comprise a pump coupled to a prime mover. The term pump can refer to a fluid end, a positive displacement pump, a plunger pump, a piston pump, a progressive cavity pump, a gear pump, a screw pump, a lobe pump, a double screw pump, an impeller and diffuser, a centrifugal pump, a multistage centrifugal pump, a turbine, or any other type of pump suitable for pressurizing fluids. In some embodiments, the prime mover can include an electric motor, an internal combustion engine, or a hybrid motor configured to alternate between the two types of motor.

As used herein, a wellbore treatment can be any fluid pumped into a wellbore during multiple stages of oil well construction. Each stage of the oil well construction process can be carried out with specialized equipment and wellbore treatments. During a drilling stage, one or more wellbore treatments can include drilling mud that is pumped into the wellbore by one or more mud pumps. Drilling mud as a wellbore treatment can bring cutting back to surface and stabilize the inner surface of the wellbore. During a cementing stage, the various wellbore treatments can include fluid loss treatments, cementitious slurry, and a variety of spacer fluids that are pumped down the wellbore by one or more cement pumps. Cement slurry, as a wellbore treatment, can be used to stabilize the wellbore, isolate subterranean formations, and form a barrier between formation fluids and a string of casing. During a completion stage, the various wellbore treatments can include one or more types of fracturing slurry that is pumped down the wellbore by one or more fracturing pumps. Fracturing slurry as a wellbore treatment can be used to fracture the wellbore, create seams, and fill the fractures with a propping material, e.g., sand, to provide a pathway for the production of wellbore fluids. Other examples of wellbore treatments can include a wide variety of fluids including acidizing fluid, resin compounds for formation consolidation or isolation, weighted fluids for well control and/or intervention, gravel packing fluids for sand placement, solvent for cleaning, water and/or completion fluids for tool placement, clean-out, circulating, jetting and other remediation treatments.

During the completion phase, the fracturing operation can pump a wellbore treatment, e.g., water and sand, with a fracturing fleet. The fracturing fleet can include a fluid supply, a proppant supply, a blending system, and a plurality of pumping units (e.g., fracturing pumps) fluidically coupled to a wellbore and the blending system by a fluid network. The fracturing fleet may be configured to provide a flowrate of the wellbore treatment from the blending system to a wellbore per a pumping schedule. In some scenarios, the fracturing fleet can comprise a group of "clean" pumps (e.g., pumping proppant-free fluids such as slick water) and a group of "dirty" pumps (e.g., pumping proppant-laden fluid) to provide a blended wellbore treatment fluid to the wellbore.

The fracturing operation may pump one or more types of wellbore treatments into the wellbore to generate and fill a network of fractures created by the pressure and flowrate of the fracturing fluid. In a scenario, the fracturing operation can pump a volume of a first wellbore treatment, e.g., a small size proppant, followed by a volume of a second wellbore treatment, e.g., a large size proppant, to generate a desired fracture network. In another scenario, the fracturing operation may pump a fracturing fluid comprised of small particles and large particles. During a pumping operation, a portion of the large particles can damage the discharge valves (e.g., prop open or otherwise prevent closure thereof or damage one or more of the valve components (disk, insert, seat, spring, retainer or valve seats) through erosion as the wellbore treatment traverses through the pump equipment. In some scenarios, the large particles or foreign materials in the proppant (rocks, chunks of metal, rags, chunks of rubber, etc.) can cause a reverse flowrate in the pump and/or reverse torque to the crank shaft as a result of damage to or propping open one or more discharge valves of the pump equipment. This reverse flowrate and/or negative torque can damage the one or more components of the drivetrain, e.g., a pump power end (crank shaft bearings, connecting rods, crossheads, case), speed reducer, driveshaft, transmission or engine, to shorten the service life of the pump equipment. A method of monitoring for reverse flowrate and/or negative torque is desirable.

Certain embodiments of the present disclosure are directed to systems and methods for monitoring one or more properties of a pressure pump utilizing sensors coupled to a unit controller. A unit controller can direct the pumping operation while receiving continuous and/or periodic datasets from the sensors. A monitoring process can determine one or more performance metrics, e.g., health status, by monitoring the continuous and/or periodic datasets from the sensors. For example, the torque measurements, flowrate measurements, discharge valve leakage measurements, or combinations thereof can be compared to one or more baselines to determine pump performance and component conditions. In a scenario, the sensor measurements can indicate the health of one or more components of the pumping equipment, e.g., a leaking valve such as a leaking discharge valve in a multi-cylinder fluid end and/or mechanical wear and tear associated with the application of negative torque on a drivetrain component.

Certain embodiments of the present disclosure are directed to systems and methods for determining a health status of a pumping unit. In some embodiments, the health status can be determined from direct measurement of mechanical properties of various mechanical systems within the pump equipment. For example, a pump monitoring system can utilize one or more sensors to measure and output a sensed parameter associate with one or more components of a pumping unit. The sensors monitored within the pump equipment can include a position sensor (e.g., to provide a location measurement), a strain gauge (e.g., to provide a strain (deformation) measurement of a component), a torque sensor (e.g., to provide a torque measurement of a component), a pressure sensor (e.g., to provide a pressure measurement), a flow meter (e.g., to provide a volumetric flow rate), an accelerometer (e.g., to provide a measurement of acceleration of a component), a temperature sensor (e.g., to provide a temperature measurement), an acoustic sensor (e.g., to provide a measurement of sound waves), or combinations thereof. For example, the torque sensor can be a mechanical sensor positioned in the power end, transmission, and/or pressure pump to directly measure the torque, e.g., torque measurement, of a component of the pump equipment proximate to the torque sensor. The position sensor may be a physical sensor configured to measure the position, e.g., position measurement, corresponding to the movement of a driveshaft and/or crankshaft in the power end. The flow meter may generate a flow measurement in one or more locations within or adjacent a fluid end of the pressure pump, for example downstream of a discharge valve to measure flow through the discharge valve from a given fluid end cylinder or the whole fluid end. The flow measurement may be compared to a baseline of normal operation to determine a health status of the pressure pump, e.g., sealing capacity of one or more valves (e.g., a discharge valve). Likewise, the torque measurements, alone or with the position measurement, may be compared to a baseline or nominal operating level to determine abnormal operational values of the pressure pump and may correspond to a condition of the one or more valves (e.g., a leaking discharge valve).

Certain embodiments of the present disclosure are directed to systems and methods for preventing and/or reducing damage to the pump equipment by monitoring the health status of pump equipment. In some embodiments, the pump monitoring system can determine a "poor health" or "failing health" status. For example, one or more sensors can confirm a change in the monitored sensors from an expected value or baseline value by a decrease in two different sensor measurements. In a scenario, a first sensor, e.g., torque, may indicate a leaking valve and a second sensor, e.g., flow sensor, may signal a decrease in flow rate and/or change in direction of the treatment fluid to confirm the torque measurement. One or more components of the pump equipment may be damaged as a result of a poor health status. For example, a splined connection, e.g., drive shaft, can experience accelerated fatigue as a result of negative torque. In another scenario, gear teeth, for example on the pump speed reducer or in the transmission, can experience repetitive shear loading from an abnormal reversal of torque (from the negative torque) during a first portion of the crank rotation and a subsequent application of positive torque for the remainder of the rotation. In some embodiments, the unit controller can decrease the pumping rate and/or stop the pumping operation in response to the determination of "poor heath" of the pump equipment. In some embodiments, a pumping unit can be removed from service in response to a decrease in the heath status of the pumping unit. In some embodiments, one or more pumping units with a diminished health status can be replaced by one or more reserve pumping units with a greater health status.

Turning now to FIG. 1, a partial cross-sectional view of a wellbore servicing environment 100 is described. In some embodiments, a pumping unit 110 may be fluidically coupled to a wellbore 112 at a wellsite 114. The wellsite 114 may be on land and the wellbore treatment and the pumping unit 110 can be optimized for the wellsite on land. In some embodiments, the remote wellsite 114 may be offshore and the wellbore treatment and pumping unit 110 can be optimized for a wellsite offshore. For example, the pumping unit 110 utilized offshore may be skid mounted whereas the pumping unit 110 utilized on land may be truck mounted or trailer mounted.

A wellbore 112 for a treatment well 118 located at the remote wellsite 114 can be drilled with any suitable drilling system. A casing string 116 can be conveyed into the wellbore 112 by a drilling rig, a workover rig, an offshore rig, or similar structure. A wellhead 120 may be coupled to the casing string 116 at surface 122. The pumping unit 110, located offshore or on land, can be fluidically coupled to a wellhead 120 by a high pressure line 124. In an aspect, a high pressure line includes pressure from about 1000 psi to about 50,000 psi, alternatively from about 5000 psi to about 50,000 psi, alternatively, from about 5000 psi, to about 45,000 psi, alternatively from about 5000 psi to about 40,000 psi, or alternatively within a range having first and second endpoints selected from the group consisting of 1000, 2000, 3000, 4000, 5000, 6000, 7000, 8000, 9000, 10,000, 11,000, 12,000, 13,000, 14,000, 15,000, 20,000, 25,000, 30,000, 35,000, 40,000, 45,000, and 50,000 psi. The wellbore 112 can extend in a substantially vertical direction away from the earth's surface 122 and can be generally cylindrical in shape with an inner surface 126. At some point in the wellbore path, the vertical portion 128 of the wellbore 112 can transition into a substantially horizontal portion 130. The wellbore 112 can be drilled through the subterranean formation 136 to a hydrocarbon bearing formation 132.

In some embodiments, the wellbore 112 can be completed with a cementing process that places a cement slurry between the casing string 116 and the wellbore 112 to cure into a cement barrier 152. The wellhead 120 can be any type of pressure containment equipment connected to the top of the casing string 116, such as a surface tree, a production tree, a subsea tree, a lubricator connector, a blowout preventer, or combination thereof. The wellhead 120 can include one or more valves to direct the fluid flow into or out of the wellbore 112 and one or more sensors that measure wellbore properties such as pressure, temperature, and/or flowrate data. Perforations 134 made during the completion process that penetrate the casing string 116 and hydrocarbon bearing formation 132 can enable the fluid in the hydrocarbon bearing formation 132 to enter the casing string 116.

In some embodiments, the pumping unit 110 comprises pumping equipment 138 and a unit controller 140. The pumping equipment 138 can comprise a pump 144 (e.g., a multi-cylinder fluid end), a speed reducer 149 (e.g., connected to a first end of a driveshaft 214), a gearbox/transmission 148 (e.g., connected to a second end of the driveshaft opposite the speed reducer, and a prime mover 146, e.g., internal combustion engine. In some embodiments, the pumping equipment 138 can comprise a pump 144 (e.g., a multi-cylinder fluid end) directly coupled to a prime mover 146, e.g., an electrical motor. In some embodiments, the unit controller 140 can direct a variable frequency drive (VFD) to deliver electrical power, e.g., voltage and current, from a local or remote power source to the prime mover 146. For example, the pump 144 can be directed by the prime mover 146 via the VFD and the unit controller 140 to deliver the treatment fluid at a desired flowrate and pressure to the wellbore 112 via the high pressure line 124. The pumping equipment 138 can receive a treatment fluid from a fluid source, e.g., a blender. In some embodiments, the pumping unit 110 can include a mixing system to blend the treatment fluid for the pumping equipment 138. The unit controller 140 may be a computer system suitable for communication with the service personnel, communication with a central controller, control of the pumping equipment 138, and control of the mixing system as will be described further herein.

The pumping unit 110 can follow a pump procedure with multiple sequential steps to deliver a wellbore treatment, e.g., proppant slurry, into the wellbore 112. The pump procedure, also referred to as a pump schedule, can comprise a series of steps or pumping stages that direct the placement of treatment fluid at a predetermined pressure, flowrate, treatment type, treatment density, or combinations thereof as a function of time and/or volume of treatment fluid. The series of steps of the pump procedure may be an estimation that concludes when a pumping operation objective is reached. For example, the pumping operation may end before the estimated completion or be extended past the estimated completion in response to the pumping operation objective being achieved. The pump procedure can include pressure testing of pumping equipment, pressure testing of piping network, treatment mixing, activation of downhole tools, and various treatment blends.

In one or more embodiments, a monitoring process, executing on the unit controller 140, can monitor the VFD and/or one or more sensors to provide an indicia of the health status of the pumping unit 110. The monitoring process can monitor one or more independent parameters and/or dependent parameters of the VFD, e.g., motor torque, and may utilize one or more sensors within the pumping equipment 138 (e.g., flow rate, gearbox torque, vibrations of various components, etc.) to determine the health of the pump and/or location of one or more failing components. In an aspect of the present disclosure, the VFD provides an indication of torque (for example, negative torque) to the controller (e.g., unit controller 140) in accordance with the systems and methods described herein.

The pumping unit 110 can be comprise any suitable pumping equipment 138 for the desired wellbore treatment. For example, the pumping equipment 138 can be one or more mud pumps for delivering drilling mud to the wellbore 112. In a second scenario, the pumping equipment 138 can comprise one or more cement pumps for delivering a cementitious slurry to the wellbore 112. In a third scenario, the pumping equipment 138 can include one or more fracturing pumps for delivering fracturing fluid or fracturing slurry to the wellbore 112. In some scenarios, the pumping equipment 138 can include a mixing system for blending the wellbore treatment, e.g., drilling mud, cementitious slurry, and/or fracturing fluid. In other scenarios, the pumping equipment 138 can be fluidically coupled to a wellbore treatment fluid source, e.g., a blender, and the wellbore 112.

In some embodiments, the wellbore servicing environment 100 can comprise additional completion equipment to direct the wellbore treatment fluids into a target location. For example, a fracturing plug, e.g., wellbore isolation plug, can be set or installed below a target location for a set of perforations, e.g., perforations 134, to isolate the wellbore 112 below the target location from pumping pressures. In some embodiments, one or more perforating guns can be utilized to produce additional perforations, in coordination with, the one or more fracturing plugs. In another scenario, a fracturing valve, e.g., production sleeve, can be coupled to the casing string 116 and installed at a target depth. The fracturing valve can be opened for the placement of a wellbore treatment and can closed afterward. Although one set or location for the perforations 134 is illustrated in the wellbore servicing environment 100, it is understood that the wellbore servicing environment can comprise 1, 2, 3, 4, 5, 6, 7, 8, 9, 10, or any number of sets of perforations 134.

Figure 2:
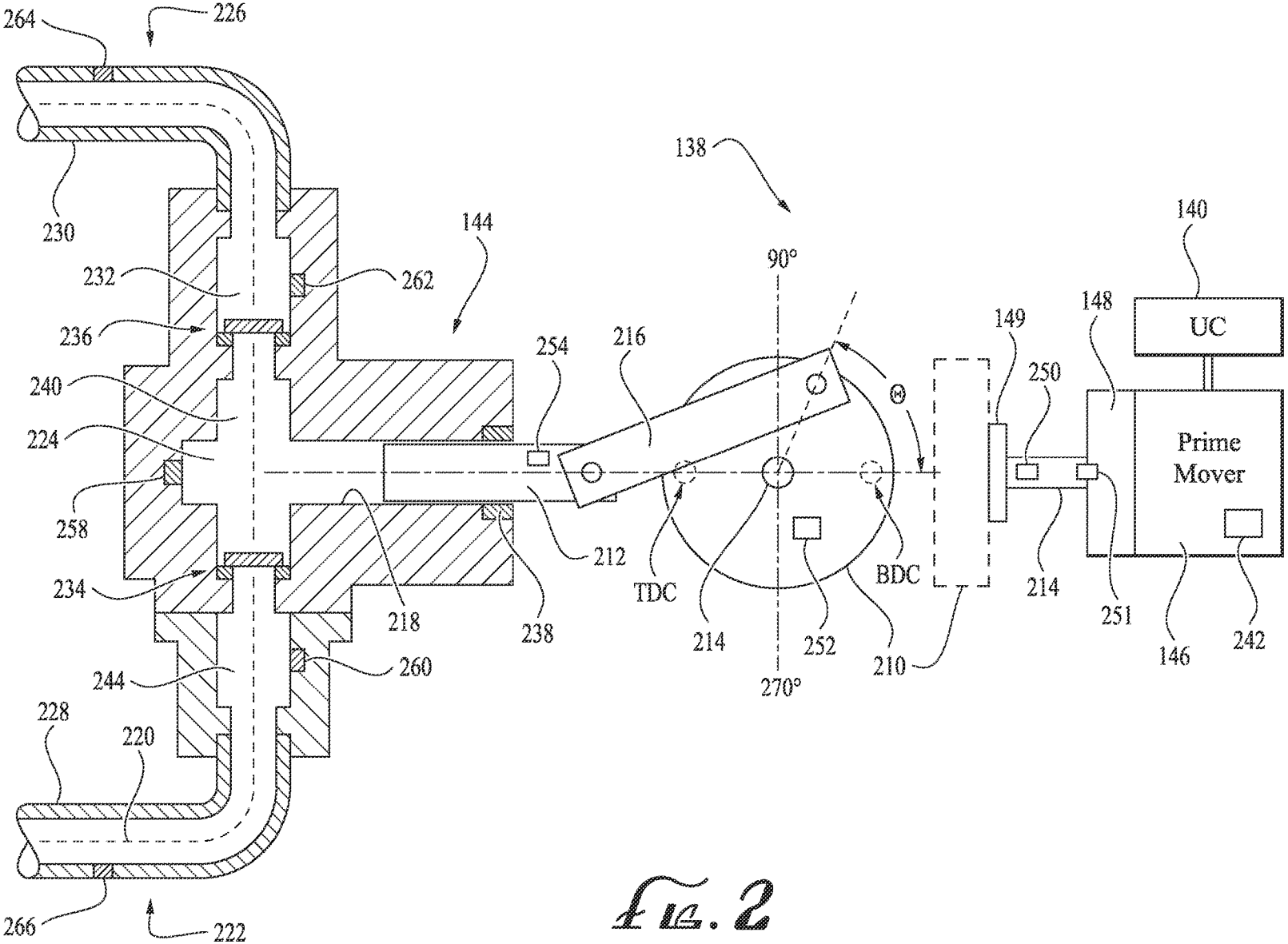
FIG. 2 is a partial cross-sectional view of pump equipment of a pumping unit according to an embodiment of the disclosure.

The unit controller 140 can receive data from one or more sensors indicative of the pumping operation and/or condition of the pumping equipment 138. Turning now to FIG. 2, an exemplary pumping equipment 138 can be described. In some embodiments, the pumping equipment 138 further comprises a crank shaft 210 rotationally coupled to the prime mover 146, a transmission 148, a VFD (when the prime mover is an electric motor), or combinations thereof and configured to reciprocate a reciprocating element 212 within the pump 144. The unit controller 140 can direct the prime mover 146 to transfer torque and rotation to the crank shaft 210 via a drive shaft 214 of the prime mover 146 and/or transmission 148 and/or speed reducer 149. In the exemplary pumping equipment 138 of FIG. 2, the prime mover 146 can transfer torque and rotation to a rotatable crank shaft 210 to power a crank arm 216 rotationally coupled to the crank shaft 210 and reciprocating element 212 (e.g., a plunger) by various linkages to extend and retract the reciprocating element 212 within an element bore 218 of the pump 144 (e.g., a multi-cylinder/bore fluid end).

In one or more embodiments, a monitoring process, e.g., an engine control module (ECM) executing on a computer (e.g., a module of a managing application 536 executing on computer 532 and in communication with the unit controller 140), can monitor the engine and/or one or more sensors to provide an indicia of the health status of the pumping unit 110. The monitoring process can monitor one or more independent parameters and/or dependent parameters of the engine, e.g., motor torque, and may utilize one or more sensors within the pumping equipment 138 (e.g., flow rate, gearbox torque, vibrations of various components, etc.) to determine the health of the pump and/or location of one or more failing components. In an aspect of the present disclosure, the ECM provides an indication of torque (for example abnormally large torque variations) to the controller (e.g., managing application 536 and/or unit controller 140) in accordance with the systems and methods described herein.

The wellbore treatment fluid can be transferred or pumped along a fluid path 220 that passes through the pump 144. The fluid path 220 can comprise an upstream fluid passage 222, a pump chamber 224, and a downstream fluid passage 226. The upstream fluid passage 222 can include a supply line 228, e.g., a suction line, fluidically coupled to an inlet chamber 244. In a context, the inlet chamber 244 can be fluidically coupled to the pump chamber, e.g., pump chamber 224, or more than one pump chamber. For example, the inlet chamber 244 can be an inlet manifold or suction header fluidically coupled to two or more pump chambers. Similarly, the downstream fluid passage 226 can comprise a high pressure line 230 and a discharge chamber 232. In some embodiments, the high pressure line 230 can be an embodiment of the high pressure line 124 illustrated in FIG. 1. In a context, the discharge chamber 232 can be fluidically coupled to the pump chamber 224 or two or more pump chambers via a discharge manifold or distribution header. In some embodiments, the supply line 228 and the high pressure line 230 can be fluidically coupled to fluid network, also referred to as a manifold or missile, that fluidically couples multiple pumping units, e.g., pumping unit 110, together. For example, the supply line 228 can be coupled to a low pressure side of the fluid network that is configured to deliver wellbore treatment fluid from a fluid source, e.g., a blender or water supply. Likewise, the high pressure line 230 can be fluidically coupled to a high pressure side of the fluid network (e.g., frack iron) that is configured to deliver the pressurized treatment fluid from the pump 144 to the wellbore 112. During pump operation, a wellbore treatment fluid can be pumped along the fluid path 220 from the upstream fluid passage 222 to the pump chamber 224 to be pressurized and then delivered to wellbore 112 via the downstream fluid passage 226.

The pump 144, also referred to as a fluid end, is illustrated as a cross-bore pump fluid end comprising the reciprocating element 212, a suction valve assembly 234, and a discharge valve assembly 236. A primary packing 238 (e.g., plunger packing) may be one or more seals, e.g., O-rings and/or packing, in sealing engagement with the reciprocating element 212 and at least a portion of the element bore 218, e.g., a seal gland. The suction valve assembly 234 may comprise a valve body, a valve seat, and a closing mechanism, e.g., a spring. Likewise, the discharge valve assembly 236 may comprise a valve body, a valve seat, and a closing mechanism. Both the suction valve assembly 234 and the discharge valve assembly can be configured to have an open configuration and a closed configuration. In the closed configuration, the valve body can sealingly engage the valve seat to prevent fluid flow and/or a loss of pressure from above the valve assembly to below the valve assembly, for example, from the downstream fluid passage 226 to the pump chamber 224. The valve assembly can open, e.g., transition to the open configuration, in response to a pressure differential below the valve assembly, for example, pressure within the pump chamber 224 being greater than pressure within the discharge chamber 232. In some embodiments, the closing mechanism can align and bias the valve body into sealing engagement with the valve seat in response to the pressure above and below the valve assembly being approximately or nearly equal. When utilized in connection with a valve assembly, 'open' and 'closed' refer, respectively, to a configuration in which fluid can flow through the valve assembly (e.g., can pass between a valve body and a valve seat thereof) and a configuration in which fluid cannot flow through the valve assembly (e.g., cannot pass between a valve body and a valve seat thereof).

During the operation of the fluid end 144, the reciprocating element 212 can draw in treatment fluid through the suction valve assembly 234 and pressurize the treatment fluid within the pump chamber 224 until the discharge valve assembly 236 opens to expel the treatment fluid. The torque and rotational motion via the drive shaft 214 of the prime mover 146 can power the reciprocating element 212 to extend and retract along a direction or axis concentric with the element bore 218 of the fluid end 144. Forward strokes, also referred to as a discharge strokes, and return strokes, also referred to as suction strokes, are correlated to the movement of the reciprocating element 212 within the element bore 218. During a forward stroke, the reciprocating element 212 extends away from the crank shaft 210 and towards (or into) the fluid end 144. Before the forward stoke begins, the reciprocating element 212 is in a fully retracted position (also referred to as bottom dead center (BDC) with reference to the crank shaft 210), in which case the suction valve assembly 234 can be in a closed configuration having allowed fluid, e.g., wellbore treatment, to flow into the (e.g., high pressure) pump chamber 224. When discharge valve assembly 236 is in a closed configuration (e.g., under the influence of a closing mechanism, such as a spring, the high pressure in a discharge pipe or a manifold containing the discharge outlet 240 or discharge chamber 232) prevents fluid flow into discharge chamber 232 and causes pressure in the pump chamber 224 to accumulate upon stroking of the reciprocating element 212. When the reciprocating element 212 begins the forward or discharge stroke, the pressure builds inside the pump chamber 224 and acts as an opening force that results in positioning of the discharge valve assembly 236 in an open configuration, while a closing force (e.g., via a closing mechanism, such as a spring and/or pressure increase inside pump chamber 224) urges the suction valve assembly 234 into a closed configuration. As the reciprocating element 212 extends forward, fluid within the pump chamber 224 is discharged through the discharge outlet 240.

During a return or suction stroke, the reciprocating element 212 translates or retracts away from (or out of) the fluid end 144 and towards the crank shaft 210 of the pumping equipment 138. Before the return stroke begins, the reciprocating element 212 is in a fully extended position (also referred to as top dead center (TDC) with reference to the crank shaft 210), in which case the discharge valve assembly 236 can be in a closed configuration having allowed fluid to flow out of the pump chamber 224 and the suction valve assembly 234 is in a closed configuration. When the reciprocating element 212 begins and retracts towards the crank shaft 210, the discharge valve assembly 236 assumes a closed configuration, while the suction valve assembly 234 opens. As the reciprocating element 212 moves away from (or out of) the fluid end 144 during a return stroke, fluid flows through the suction valve assembly 234 and into the pump chamber 224.

While the foregoing discussion focused on a fluid end 144 comprising a single reciprocating element 212 disposed in a single element bore 218, it is to be understood that the fluid end 144 may include any suitable number of reciprocating elements. For example, the pumping equipment 138 may comprise a plurality of reciprocating elements 212 with corresponding reciprocating element bores 218 arranged in parallel and spaced apart along a planar arrangement. For example, the pumping equipment may comprise 1, 2, 3, 4, 5, 6, 7, 8, 9, or any number of reciprocating elements 212 with corresponding reciprocating element bores 218. In such a multi-bore pump (e.g., multi-cylinder fluid end), each element bore 218A-Z may be associated with a corresponding reciprocating element 212A-Z and crank arm 216A-Z, and a single common drive shaft 214 from the prime mover 146 may drive each of the plurality of reciprocating elements 212A-Z and crank arms 216A-Z via a common crank shaft 210. Alternatively, a multi-bore pump may include multiple crankshafts 210A-Z, such that each crankshaft 210A-Z may drive a corresponding reciprocating element 212A-Z. Furthermore, the pumping equipment 138 may be implemented as any suitable type of multi-bore pump. In a non-limiting example, the pumping equipment 138 may comprise a Triplex pump, also referred to as a three plunger pump, having three reciprocating elements 212A-C (e.g., plungers or pistons) and associated reciprocating element bores 218A-C, discharge valve assemblies 236A-C and suction valve assemblies 234A-C, or a Quintuplex pump, also referred to as a five plunger pump, having five reciprocating elements 212A-E and five associated reciprocating element bores 218A-E, with corresponding discharge valve assemblies 236A-E and suction valve assemblies 234A-E. Although the pump 144 is illustrated as a cross-bore pump fluid end, it is understood that the pump 144, e.g., fluid end, may be configured as an in-line, also called a concentric bore fluid end, a "T-bore" fluid end, a "X-bore" fluid end, a "Y-bore" fluid end, or any other suitable configuration of fluid end.

The unit controller 140 can monitor one or more sensors coupled to the power end and/or the pump equipment 138. The power end can comprise the prime mover 146, the transmission 148, and the drive shaft 214. A motor sensor 242 may be coupled to the prime mover 146, for example, a temperature sensor, a vibration sensor, or both. One or more torque sensors 251 may be coupled to the drive shaft 214 and/or the transmission 148. One or more positional sensors may be coupled to the unit controller 140. For example, the drive shaft 214 may include a rotary encoder 250, e.g., a position sensor. In some embodiments (e.g., where the prime mover includes an electric motor), a variable frequency drive (VFD) may be communicatively coupled between the unit controller 140 and the prime mover 146, e.g., an electric motor. In some embodiments, the transmission 148 may be omitted, for example, when the prime mover 146 is an electric motor.

The one or more torque sensors 251 may be positioned in one or more locations within the power end or the fluid end 144 of the pumping unit 110. The one or more torque sensors 251 may include a single torque sensor, e.g., located on a drive shaft, or multiple torque sensors located within the prime mover 146, the transmission 148, the drive shaft 214, the crank shaft 210, or combinations thereof. The one or more torque sensors 251 can include a torque transducer, a torque-meter, strain gauges, or any suitable sensor for measuring stress, strain, or torque. For example, the torque sensor 251 may be incorporated into the transmission 148 using slip rings, calibrated tone wheels, or wireless torque meters.

In some embodiments, the VFD, when present, may output a torque value to the unit controller 140. The VFD may be described as a variable frequency drive, an adjustable frequency drive, an adjustable speed drive, a variable speed drive, an AC drive, a micro drive, an inverter drive, or any other suitable controller for an electric motor configured to control speed and torque by varying the frequency of the input electricity, e.g., voltage and current. Typically, the VFD is a solid-state power conversion system comprising a rectifier bridge converter, a direct current link, and an inverter and may be configured as a voltage source inverter (VSI) drive, current source inverter (CSI) drive, six-step inverter drive, load commutated inverter (LCI) drive, matrix converter (MC), cycloconverter, or doubly fed slip recovery system. The configuration of the VFD can be dependent on the prime mover 146, the power source, the operating environment, or combinations thereof. For example, a VFD is typically used with a three-phase induction motor, however any type of electric motor may be utilized including single-phase motors, synchronous motors, axial flux motors, permanent magnet motors, or any combination thereof. The VFD may output independent parameters and dependent parameters to the unit controller 140. The independent parameters can include output frequency, output voltage, set acceleration rate, and set deceleration rate to the prime mover 146. The VFD may include one or more processors and non-transient memory configured to output one or more dependent parameters based on algorithms executing in memory. For example, the VFD can determine motor speed, output current, output torque based on one or more dependent parameters of the VFD, the prime mover 146, the pumping operation, or combinations thereof.

The one or more positional sensors may include a rotary encoder 250, crankshaft sensor 252, stroke sensor 254, or combinations thereof. The rotary encoder 250, also referred to as a shaft encoder, may provide data on the angular motion of the drive shaft 214 including position, speed, distance, or any combination thereof. The rotary encoder 250 may be an absolute rotary encoder, an incremental encoder, or any electro-mechanical device that converts angular position or motion to analog and/or digital signals. The crankshaft sensor 252 can be an inductive sensor, a hall effect sensor, magneto-resistive sensor, optical sensor, or any other type of sensor configured to determine the position and speed of the crankshaft. For example, the crankshaft sensor 252 can determine an angle θ relative to a TDC (e.g., 180 degrees) and/or BDC (e.g., 0 or 360 degrees) location of the crank shaft 210. The stroke sensor 254 can be coupled to each of the reciprocating elements 212 to provide data on the location and speed of each reciprocating elements 212 relative to the corresponding element bore 218. Although three types of sensor located in three distinct locations are disclosed, it is understood that that any variety of positional sensor configured to detect or confirm the position of each reciprocating element 212 and/or valve position located along the fluid path 220 to measure valve effectiveness and timing can be utilized.

The pump 144 may include one or more pressure and flowrate sensors. The one or more sensors can include a first fluid sensor 260 fluidically coupled to the inlet chamber 244, a second fluid sensor 262 coupled to the discharge chamber 232, a third fluid sensor 264 coupled to the high pressure line 230, a fourth fluid sensor 266 coupled to the supply line 228, or combinations thereof. Each of the fluid sensors can include a pressure sensor (e.g., a pressure transducer), a flowrate sensor, a temperature sensor, a density sensor, a vibration sensor (e.g., an accelerometer), or combinations thereof and be communicatively coupled to the unit controller 140. One or more sensors can include a pressure sensor 258 fluidically coupled to the pump chamber 224. The pressure sensor 258 can be a pressure transducer, a strain gauge, or any other type of sensor configured to measure pressure within the pump chamber 224 and communicatively coupled to the unit controller 140.

In some embodiments, a monitoring system and process can determine a decline in the health of the pumping equipment 138 of the pumping unit 110 by comparing the measurements (e.g., torque values, flow rate values, discharge valve leakage values, or combinations thereof) from one or more sensors 250 to a threshold/baseline condition or expected value. The monitoring process may determine a "caution status" for a relatively small decline of torque measurements, flow rate measurements, and/or discharge valve leakage rate measurements from the threshold/baseline condition or expected value. In another scenario, the monitoring process may determine a "danger status" in response to a one or more torque measurements, flow rate measurements, and/or discharge valve leakage rate measurements that deviate from a threshold/baseline condition or expected value (e.g., a torque or flow rate having a negative value). Additionally, or alternatively, the unit processor 140 may monitor for leakage in one or more discharge valve assemblies 236 and likewise determine a danger status, for example where a single discharge valve is leaking in a 3-plunger pump or where two discharge valves located in successively firing chambers of a 5-plunger pump are leaking. In some embodiments, the unit processor 140 may reduce and/or shut down the pumping operation of the pump unit 110 in response to a danger condition, e.g., a negative torque measurement, a negative flow rate measurement, a single leaking discharge valve in a 3-plunger pump, two leaking discharge valves in adjacently firing chambers of a 5-plunger pump, or combinations thereof.

As noted in the discussion of FIGS. 3-6 herein, certain characteristics of torque measurements, flow rate measurements, discharge valve leakage measurements, or combinations thereof may be indicative of one or more operational conditions that may be harmful to one or more components of a pumping system, for example the pumping system as described and shown with reference to FIG. 2. For example, certain characteristics of torque measurements as a function of crankshaft position (e.g., crank angle during 360 degree rotation of the crankshaft 210), flow rate measurements as a function of crankshaft position (e.g., crank angle during 360 degree rotation of the crankshaft 210), discharge valve leakage measurements, or combinations thereof may be indicative of one or more operational conditions (e.g., negative torque, negative flow rate, or both; damaged adjacent discharge valves on a 5-plunger pump; a damaged discharge valve on a 3-plunger pump; or any combination thereof) that may be harmful to one or more mechanical drive and/or linkage components of a pumping system, for example the drivetrain components linking the prime mover 146 to the plunger 212 as shown with reference to FIG. 2. Accordingly, disclosed herein are systems and methods for monitoring operations of a pump system (e.g., with reference to FIGS. 1 and 2 a pumping unit 110 comprising pumping equipment 138 or with reference to FIG. 7 pumping units 522 for carrying out a hydraulic fracturing operation) using a variety of sensors described herein and identifying one or more operational conditions (e.g., negative torque, negative flow rate, or both; damaged adjacent discharge valves on a 5-plunger pump; a damaged discharge valve on a 3-plunger pump; or any combination thereof) and adjusting one or more operational conditions of the pumping system to prevent, mitigate, or minimize harm to one or more mechanical drive and/or linkage components of a pumping system, for example the prime mover 146 and the drivetrain components linking the prime mover 146 to the plunger 212 as shown with reference to FIG. 2. In an aspect, adjusting an operation condition of the pump includes adjusting a flow rate of the pump, for example halting pumping by stopping or disconnecting the prime mover.

Additionally, disclosed herein are systems and methods for computerized monitoring of operations of a pump system (e.g., with reference to FIGS. 1 and 2 a pumping unit 110 comprising pumping equipment 138 or with reference to FIG. 7 pumping units 522 for carrying out a hydraulic fracturing operation) using a variety of sensors described herein (e.g., torque sensors, flow sensors, discharge valve leakage sensors, vibration sensors, accelerometers, acoustic sensors, etc.) and identifying one or more operational conditions (e.g., negative torque, negative flow rate, or both; damaged adjacent discharge valves on a 5-plunger pump; a damaged discharge valve on a 3-plunger pump; or any combination thereof) and automatically adjusting (e.g., via a computerized controller) one or more operational conditions of the pumping system to prevent, mitigate, or minimize harm to one or more mechanical drive and/or linkage components of a pumping system, for example the prime mover and/or drivetrain components linking the prime mover 146 to the plunger 212 as shown with reference to FIG. 2. In an aspect, adjusting an operation condition of the pump includes adjusting a flow rate of the pump, for example halting pumping by stopping or disconnecting the prime mover.

Additionally, disclosed herein are systems and methods for computerized monitoring of operations of a pump system (e.g., with reference to FIGS. 1 and 2 a pumping unit 110 comprising pumping equipment 138 or with reference to FIG. 7 pumping units 522 for carrying out a hydraulic fracturing operation) using a variety of sensors described herein (e.g., torque sensors, flow sensors, valve-leakage sensors, vibration sensors, etc.) and identifying one or more operational conditions (e.g., negative torque, negative flow rate, or both; damaged adjacent discharge valves on a 5-plunger pump; a damaged discharge valve on a 3-plunger pump; or any combination thereof) and automatically adjusting (e.g., via a computerized controller) one or more operational conditions of the pumping system (e.g., altering a pumping rate of the pump, halting reciprocation of the plurality of plungers, shutting down the pump, turning the pump off, disconnecting the fluid end from the power end (e.g., placing the pump in a neutral via a gearbox or mechanically disconnecting/decoupling the power end from the fluid end)) to prevent, mitigate, or minimize harm to one or more mechanical drive and/or linkage components of a pumping system, for example the prime mover and/or the drivetrain components linking the prime mover 146 to the plunger 212 as shown with reference to FIG. 2.

Figure 7:
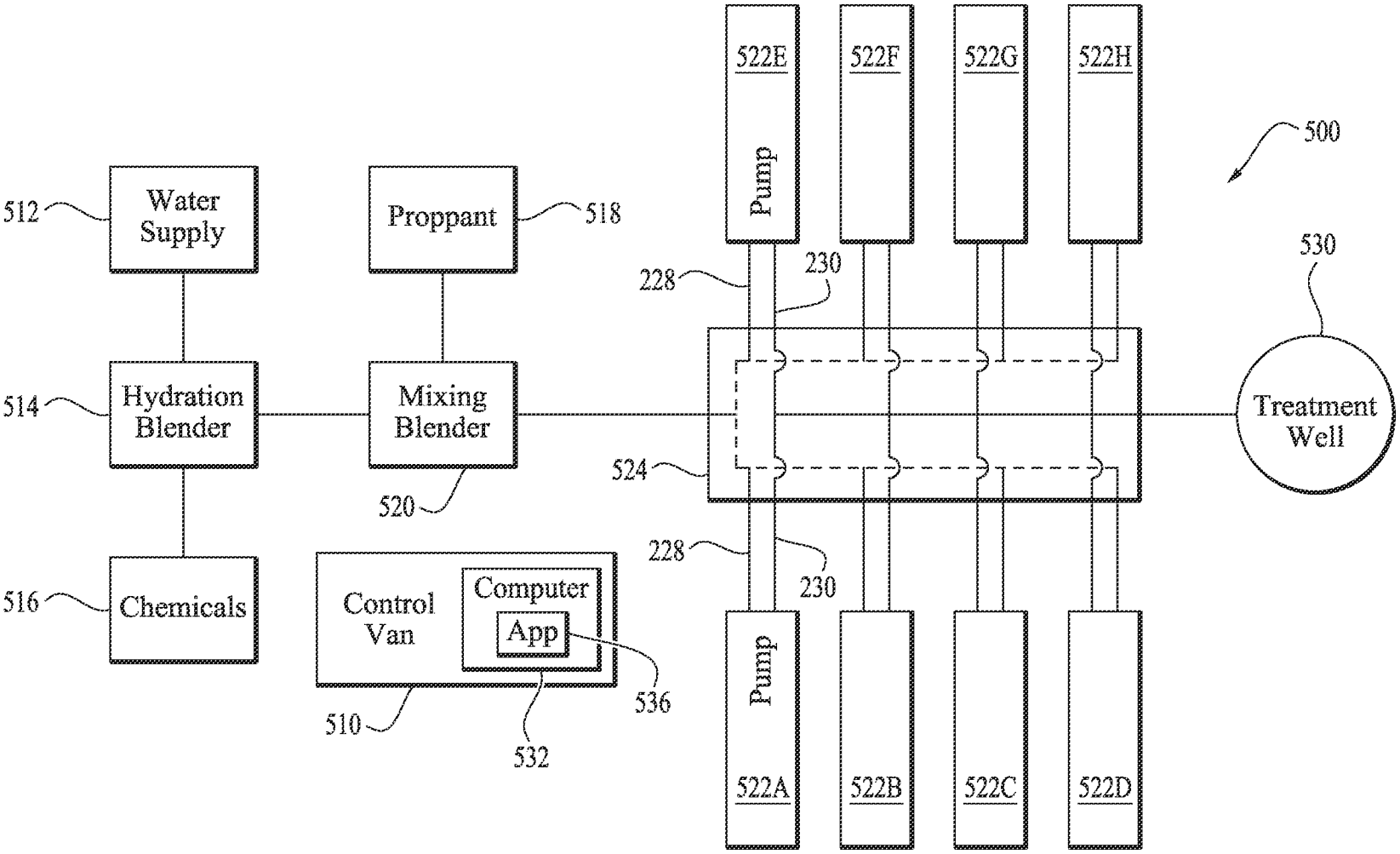
FIG. 7 is a schematic view of a blended fracturing fleet according to an embodiment of the disclosure.
Figure 9:
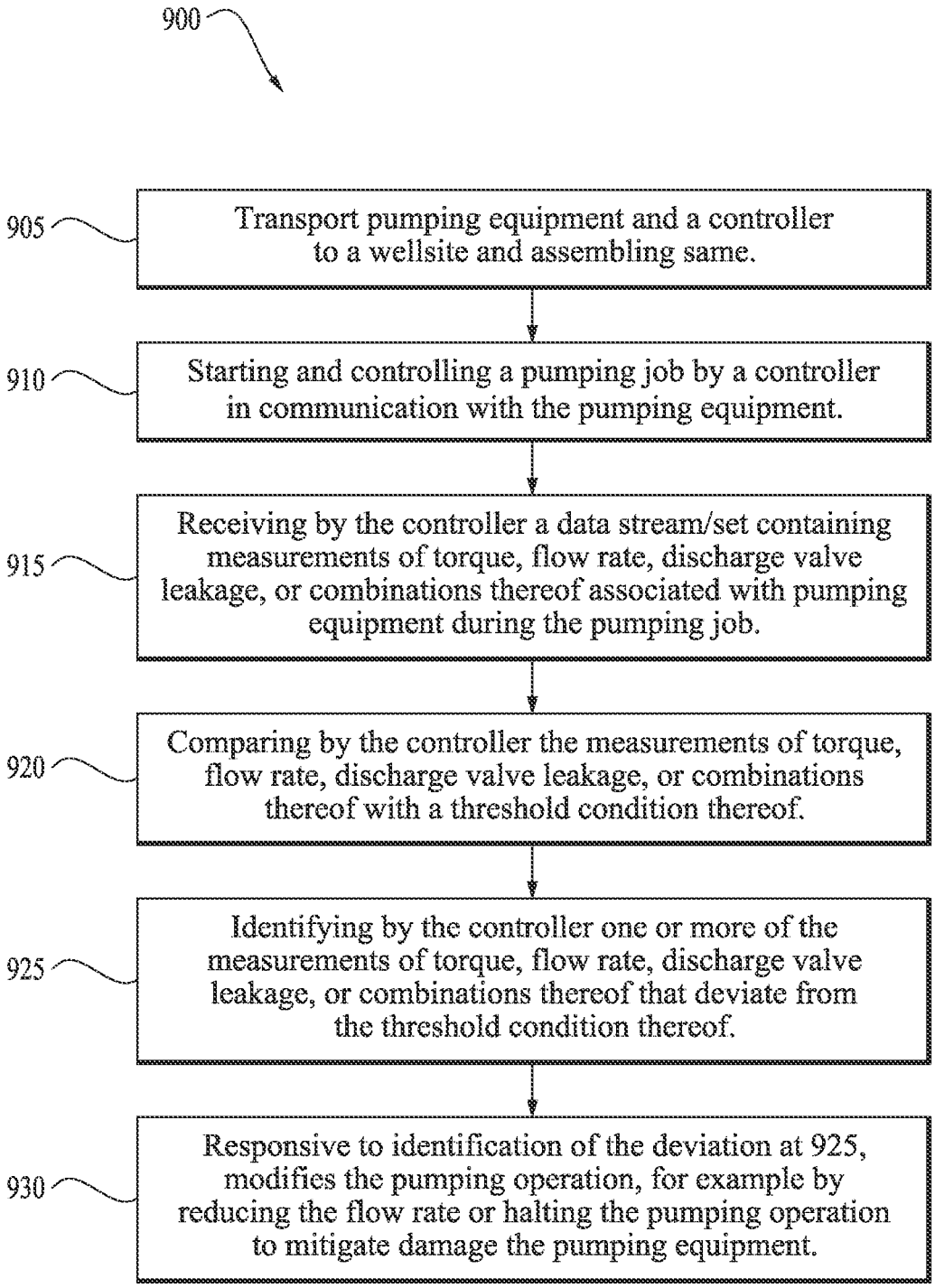
FIG. 9 is a flow chart of a method of pumping a wellbore treatment fluid according to an embodiment of the disclosure.

Referring to FIG. 9, a flowchart is provided of a method 900 of pumping a treatment fluid into a wellbore with a pumping system of the type disclosed herein. Beginning at block 905, the method includes transporting and assembling pumping equipment at a wellsite, for example transporting a plurality of pumping units 110 comprising pumping equipment 138 to a wellsite 114 as shown in FIGS. 1 and 2 and configuring the equipment to pump a treatment fluid into an interior flowbore 154 of treatment well 118. In a particular configuration as shown in FIG. 7, the plurality of pumping units 110 can be further combined to form a fracturing spread or fleet 500 configured to perform a hydraulic fracturing treatment on one or more wells by preparing and pumping fracturing fluid into the wells as described herein.

Each pumping unit 110 of the plurality of pumping units assembled at a wellsite may include a pump fluid end comprising a plurality of pump chambers, each pump chamber comprising a bore having a reciprocatable plunger disposed therein, a suction valve, and a discharge valve; a prime mover mechanically coupled to the fluid end (e.g., by a drivetrain) and configured to reciprocate the plungers; and a controller communicatively coupled to the prime mover, the fluid end, or both and configured to alert a user (e.g., sound an alarm) re a pump malfunction, initiate corrective action of the pump malfunction, or both in response to: (a) an indication of torque reversal during operation of the pumping system, (b) an indication of negative flow rate from the pump during operation of the pumping system, (c) an indication of leakage of (i) a single discharge valve in a 3-plunger pump or (ii) discharge valves associated with two plungers in adjacent/successive firing order (e.g., firing order is the sequential order in which the plungers are reciprocated from a fully retracted position at the end of a suction stroke to a fully extended position at the end of a discharge stroke), or (d) any combination of (a)-(c).

The various components of each pumping equipment, including the pump fluid end, prime mover, and various sensors and monitoring systems can be of the type disclosed and discussed herein with reference to FIGS. 1 and 2. The controller can be a unit controller 140 of the type described herein with reference to FIG. 2. Additionally, or alternatively, the controller can be encompassed within a frac fleet controller 532 of the type described herein with reference to FIG. 7, for example a supervisory/managing controller 532 communicatively coupled to a plurality of unit controllers 120 to coordinate overall pumping operations in accordance with a managing application 536 (e.g., job pumping schedule), with each unit controller 120 controlling a respective unit specific pump fluid end and prime mover. In an aspect, the controller (e.g., unit controller 140 and/or frac fleet computer 532) comprises one or more processors and memory (e.g., non-transient memory), wherein the memory is configured to store data and instructions that are retrievable and executable by the one or more processors to perform one or more methods described herein (e.g., methods to control the pumping equipment and perform the pumping operations described herein). In an aspect, the controller (e.g., unit controller 140 and/or frac fleet computer 532) may comprise one or more components of an exemplary computer system 700 described in FIG. 8.

Referring to FIG. 9, the method proceeds to block 910 where the plurality of pumping units are started and controlled by the controller to pump a treatment fluid (e.g., fracturing fluid) into the wellbore in accordance with an operation plan for the wellbore treatment operation (e.g., in accordance with a pumping schedule associated with a hydraulic fracturing job).

The method proceeds to block 915 where the controller receives one or more data streams or data sets communicated to the controller by one or more sensors and/or monitoring systems coupled to the pumping unit. The data stream or data set received by the controller may comprise one or more parameters associated with operation of one or more components of a pumping unit 120 during operation thereof. The one or more parameters may be obtained from sensors and/or monitoring devices disposed upon, communicatively coupled with, or otherwise configured to monitor and/or obtain data from one or more components of the pumping unit 120, e.g., the pump fluid end, the prime mover, and/or a drivetrain mechanically connecting the prime mover to the pump fluid end to reciprocate the plurality of plungers 212 within their respective bores 218. The parameters of the data stream or data set can comprise: (a) a torque value from a torque sensor of a torque monitoring system coupled to the pump fluid end, prime mover, and/or drivetrain during operation of the pumping system, (b) the condition of each discharge valve in a multi-plunger pump (e.g., in a 5-plunger pump) from a valve-leakage sensor of a valve-leakage monitoring system coupled to the pump fluid end, prime mover, and/or drivetrain during operation of the pumping system, (c) the condition of each discharge valve in a 3-plunger pump from a valve-leakage sensor (e.g., a vibration sensor, an accelerometer, an acoustic sensor, or combinations thereof) of a valve-leakage monitoring system coupled to the pump fluid end, prime mover, and/or drivetrain during operation of the pumping system, (d) a flow rate value for the pump from a flow rate sensor of a flow rate monitoring system coupled to the pump fluid end, prime mover, and/or drivetrain during operation of the pumping system, or (e) any combination of (a)-(d). Additionally, the parameters of the data stream or data set may comprise a parameter (f) which is a measurement for location of the crankshaft in degrees of rotation (e.g., with reference to zero degrees at BDC and 180 degrees at TDC) corresponding to each measurement or value of parameters (a)-(e). Accordingly, each parameter (a)-(e) can be associated with crankshaft position (f) over a period of time, for example to yield curves of parameters as a function of crank angle over a desired period of time (e.g., a monitoring period associated with a corresponding number of revolutions of the crankshaft), as shown in FIGS. 3-6.

The method proceeds to block 920 where the controller compares the one or more parameters (a)-(f) to a corresponding baseline or threshold condition (a)-(d) associated with each parameter, wherein threshold condition (a) is an indication of negative torque, threshold condition (b) is an indication of the leakage of discharge valves associated with two plungers in adjacent/successive firing order of the 5-plunger pump (e.g., firing order is the sequential order in which the plungers are reciprocated from a fully retracted position at the end of a suction stroke to a fully extended position at the end of a discharge stroke), threshold condition (c) is an indication of leakage of a discharge valve associated with a single plunger in the 3-plunger pump; and threshold condition (d) is an indication of negative flow rate from the pump, and threshold condition (e) is any combination of threshold conditions (a)-(d), and threshold condition (f) is any of threshold conditions (a)-(e) further expressed as a function of crankshaft angle (e.g., having a number of rotations over a given monitoring period).

The method proceeds to block 925 wherein the controller identifies one or more parameter (a)-(f) (e.g., one or more of the measurements of torque, flow rate, discharge valve leakage, or combinations thereof) that deviate from the corresponding threshold conditions (a)-(f) thereof The method proceeds to block 930 where the controller modifies the pumping operation (e.g., initiates corrective action) in response to the one or more parameters deviating (e.g., not meeting) the threshold condition (a), (b), (c), (d), (e), (f), or any combination thereof. The initiation of corrective action by the controller comprises slowing or halting reciprocation of the plurality of plungers of the malfunctioning pump. The slowing reciprocation of the plurality of plungers includes slowing a speed of the prime mover (e.g., electric motor or combustion engine). The halting of reciprocation of the plurality of plungers includes shutting down the pump, turning the pump off, mechanically disconnecting or decoupling the fluid end from the power end, placing the pump in a neutral via a gearbox or transmission, or any combination thereof. The initiation of corrective action by the controller can further comprise, concurrent with or subsequent to slowing or halting reciprocation of the plurality of plungers of the malfunctioning pump, (i) starting one or more backup pumps to pump the fluid, (ii) increasing pumping rate of one or more additional pumps pumping the fluid, or (iii) both (i) and (ii). In an aspect, modifying the pumping operation comprises i) reducing a motor/engine speed or ii) stopping the pump of a pumping unit having a damaged (e.g., leaking) discharge valve.

Further disclosed herein is a pumping system, comprising: a pump fluid end comprising a plurality of pump chambers, each pump chamber comprising a bore having a reciprocatable plunger disposed therein, a suction valve, and a discharge valve; a prime mover mechanically coupled to the fluid end and configured to reciprocate the plungers; and a controller configured to alert a user (e.g., sound an alarm), initiate corrective action, or both in response to an indication of torque reversal (indicated by negative torque value from a torque monitoring system in accordance with the discussion of FIGS. 5A, 5B, 6A, and 6B) during operation of the pumping system to pump a fluid. The indication of torque reversal can comprise a negative torque value detected by a torque monitoring system comprising a torque sensor coupled to the pump fluid end, prime mover, or drivetrain and provided to the controller during operation of the pumping system to pump a fluid. In an aspect, the negative torque value detected by the torque monitoring system can be associated with a drivetrain component mechanically coupling the prime mover to the fluid end. The drivetrain component can be a rotating drive shaft, a rotating crankshaft, or a rotating component (e.g., gear) of a transmission or gear box. The negative torque value can be a function of rotational angle of the crankshaft as the crankshaft rotates 360 degrees during reciprocation (e.g., a suction and discharge stroke) of the plunger. The negative torque value can repeat itself during each successive 360-degree rotation of the crankshaft. The negative torque value can be, for example, in a range of less than zero to about −5000 lb-ft.

Figure 3A:
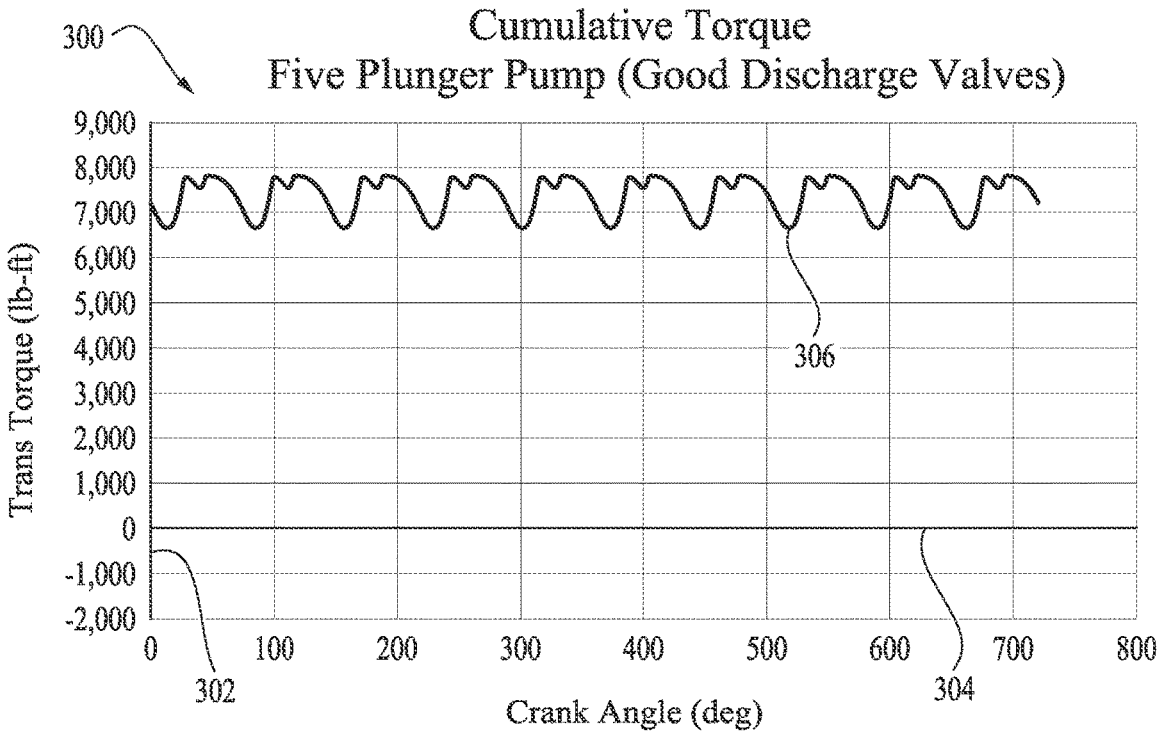
FIG. 3A-B are normal torque profile plots for a 5 cylinder pump according to an embodiment of the disclosure.
Figure 3B:
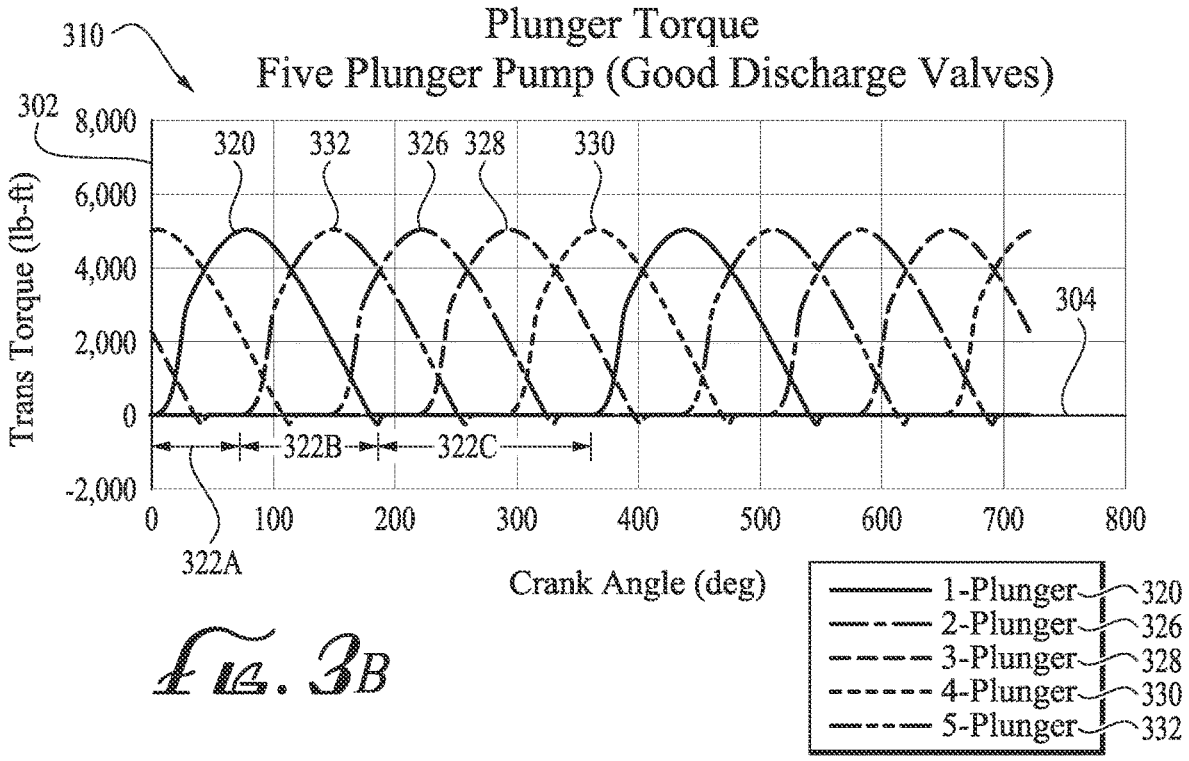

Turning now to FIGS. 3A and 3B, cumulative and individual plunger torque profile plots, respectively, of a 5-plunger pump are shown, wherein torque measured at the driveshaft 214 of the transmission 148 (Trans Torque in lb-ft) is shown as a function of crankshaft angle (Crank Angle in degrees) over a monitoring period of operation of the pump. In some embodiments, the exemplary cumulative torque profile plot 300 of FIG. 3A and individual plunger torque profile plot 310 of FIG. 3B can be illustrative of the same five plunger pump with a first axis 302 representing torque and a second axis 304 representing crank angle. For example, the cumulative torque curve 306 of FIG. 3A can represent the summation of torque measurement for each individual plunger as shown in FIG. 3B Stated alternatively, cumulative torque curve in FIG. 3A is the sum or total torque experienced by one or more mechanical components (e.g., Trans Torque measured by torque sensor 251) connecting the prime mover to the plurality of plungers. The torque values for each plunger of an individual plunger torque profile plot (e.g., FIGS. 3B, 4B, 5B, and 6B) can be determined via kinematic modeling of the type and size of the pump and fluid being pumped (e.g., number of plungers, plunger diameter, discharge pressure of the pump, bulk modulus of the fluid being pumped, etc.).

The plot 310 of FIG. 3B comprises five independent curves representing each of the five plungers, e.g., reciprocating element 212 of a 5-plunger version of the pump 144. A first torque curve 320 of the first plunger (e.g., a reference plunger having BDC at 0 degrees and TDC at 180 degree) can track the torque of the drivetrain (e.g., crank shaft 210, drive shaft 214, transmission 148) to stroke the plunger, e.g., reciprocating element 212, within the bore 218. For example, a first portion 322A of the first torque curve 320 can correspond to the stroke of the reference plunger as the crankshaft 210 travels from BDC (fully retracted position at 0 degrees crank angle) to 90 degrees. A second portion 322B can correspond to the stroke of the reference plunger as the crankshaft 210 travels from 90 degrees to TDC (fully extended position at 180 degrees crank angle). A third portion 322C can correspond to the return or suction stroke of the reference plunger, e.g., reciprocating element 212, as the crankshaft 210 travels from TDC, 270 degrees, and back to BDC, e.g., zero degrees. A brief negative torque measurement may be present in each of the torque curves, e.g., curve 320, at TDC in response to a resultant force from the pumping pressure within the fluid chamber 224 pushing on the front face of the plunger, e.g., reciprocating element 212. The brief negative torque measurement disappears after 1 to 4 degrees as a result of the closure of the discharge valve 236 and decompression of the fluid trapped in the bore from the increasing volume of the chamber 224 via the return stroke of the element 212. Once the fluid is decompressed, further increase of volume of the chamber 224 via the return stroke of the element 212 creates suction to draw treatment fluid through the suction valve 234.

The first torque curve 320 can continuously cycle through a first portion 322A, the second portion 322B, and the third portion 322C, e.g., corresponding to 360 degrees of rotation of the crankshaft 210 per reciprocation cycle of a given plunger, during the pumping operation. Each of the other plungers can have a torque curve with three similar portions, but having degree values for BDC and TDC (i.e., TDC=BDC+180 degrees) that are offset from the reference plunger by an amount equal to 360 degrees divided by the number of plungers driven by a common crankshaft (and assuming equal distribution of the location of mechanical coupling of the plunger to the crankshaft). For example, the exemplary torque profile plot 300 of the 5-plunger pump may include the first torque curve 320, a second torque curve 326, a third torque curve 328, a fourth torque curve 330, and a fifth torque curve 332 corresponding to plungers 1-5 as noted in the legend of the FIGS. 3-5, with plunger 1 being the reference plunger having BDC at 0 or 360 degrees and TDC at 180 degrees. Each of the plungers can produce simultaneous torque curves offset by 72 degrees, for example, the first torque curve 320 (for the reference plunger 1) may begin at zero degrees and the fifth torque curve 332 (for the fifth plunger) may begin at 72 degrees. Although the crank angle on the second axis 304 begins at zero, it is understood that the beginning and ending angles are arbitrary as each of the torque curves are continuous and sequential, for example, a continuous loop that begins again at the end of a complete pump stroke.

Accordingly, plungers 1-5 are arranged in a "firing sequence" or "firing order" with reference to the start of the discharge stroke for a given plunger when positioned at BDC. An exemplary plunger firing order shown in the Figures is 1-5-2-3-4. That is with reference to crankshaft 210 of FIGS. 3-5, reference plunger 1 fires at 0 degrees, plunger 5 fires at 72 degrees, plunger 2 fires at 144 degrees, plunger 3 fires at 216 degrees, and plunger 4 fires at 288 degrees. The firing sequence of the plungers is independent of the physical arrangement of the plungers, and therefore plungers need not be physically adjacent to each other in order to fire in adjacent order. For example, in a 5-plunger pump having plungers arranged side by side in a fluid end and numbered 1-5 in successive order from one side of the fluid end to the other side of the fluid end, plungers 1 and 5 are not physically adjacent to each other but can be arranged to fire adjacently (e.g., in successive order, one after the other) based upon the arrangement of their connection to the crankshaft 210 as described above with reference to the start of a discharge stroke thereof. Any firing order will yield the same net torque on the crankshaft when the 5 plungers have 72 degrees between each. Although the crank angle on the second axis 304 is described as a measurement of the crankshaft 210, it is understood that the measurement for the crank angle could be taken from the drive shaft of the prime mover 146, the transmission 148, the crank shaft 214 of the pump equipment 138, a dependent parameter from the VFD, or combinations thereof.

Returning to FIG. 3A, which is a plot of Trans Torque in lb-ft as a function of Crank Angle in degrees (deg), the exemplary cumulative torque curve 306 is the summation of torque measurement for the first plunger (curve 320), the second plunger (curve 326), the third plunger (curve 328), the fourth plunger (curve 330), and the fifth plunger (curve 332). For example, the value of the curve 306 at 100 degree crank angle of 7,800 lb-ft is the summation of 3,000 ft-lbs for fifth plunger 332 (reference FIG. 3B), and 4,400 lb-ft for first plunger 320, and 400 lb-ft for fourth plunger 330, zero lb-ft for third plunger 328, and zero lb-ft for second plunger 326. In this example, the third plunger 328 and second plunger 326 are zero during the return stroke or suction stroke. As shown, the cumulative torque curve 306 can form a repeating pattern.

In some embodiments, the monitoring process can determine a cumulative torque curve, e.g., curve 306, for each stage within the pumping procedure. The pumping procedure may comprise a plurality of steps and/or stages comprising pumping pressure, treatment fluid type, treatment density, treatment volumes, flowrates, or combinations thereof. The monitoring process may determine a new cumulative torque curve for each change in the pumping procedure and/or change in the downhole environment. For example, the pressure required to pump a treatment fluid into the wellbore may increase or decrease during later stages of the pumping procedure and thus, the cumulative torque curve may change during later stages. In some embodiments, the cumulative torque curve can be unique for each stage due to changes in the pumping procedure and/or changes in the downhole environment. In some embodiments, a change in pattern may be determined when the pump is otherwise operating in a steady state condition (e.g., all or a portion of the operating variables such as pumping rate and pressure are holding about constant in comparison to a control or target value for each said variable).

Figure 4A:
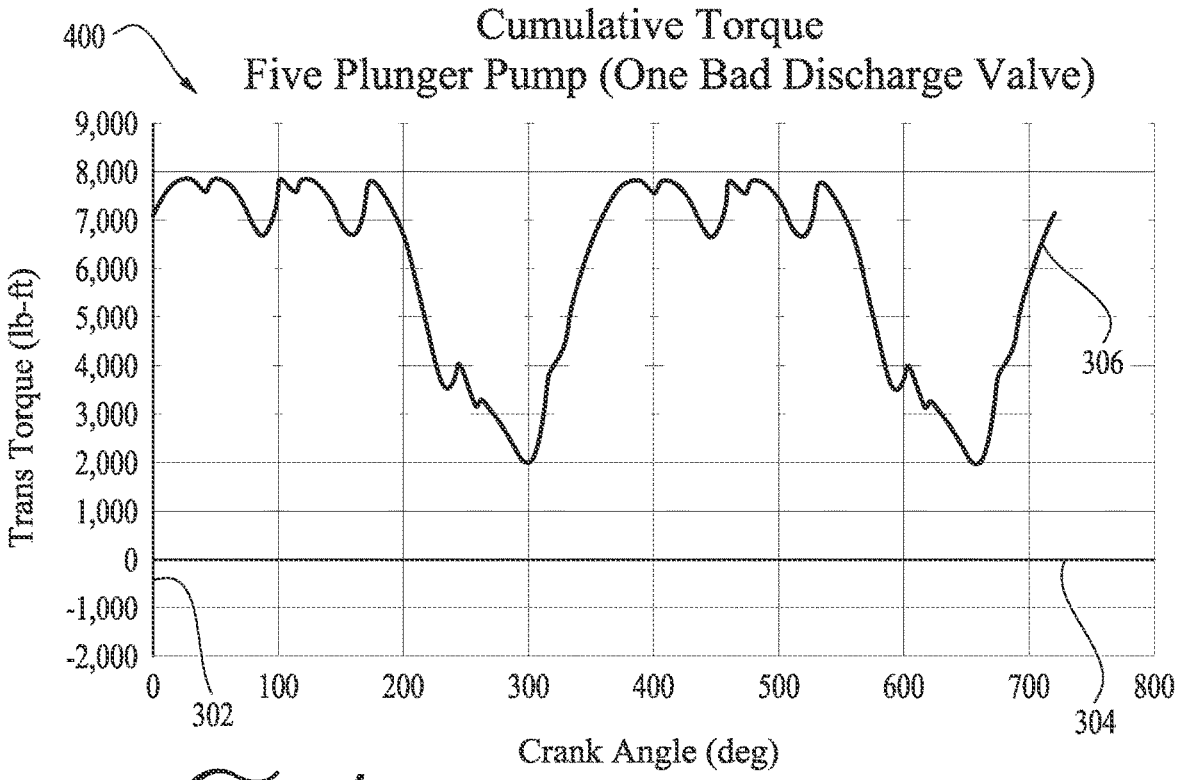
FIG. 4A-B are torque profile plots for a 5 cylinder pump with one damaged discharge valve according to an embodiment of the disclosure.
Figure 4B:
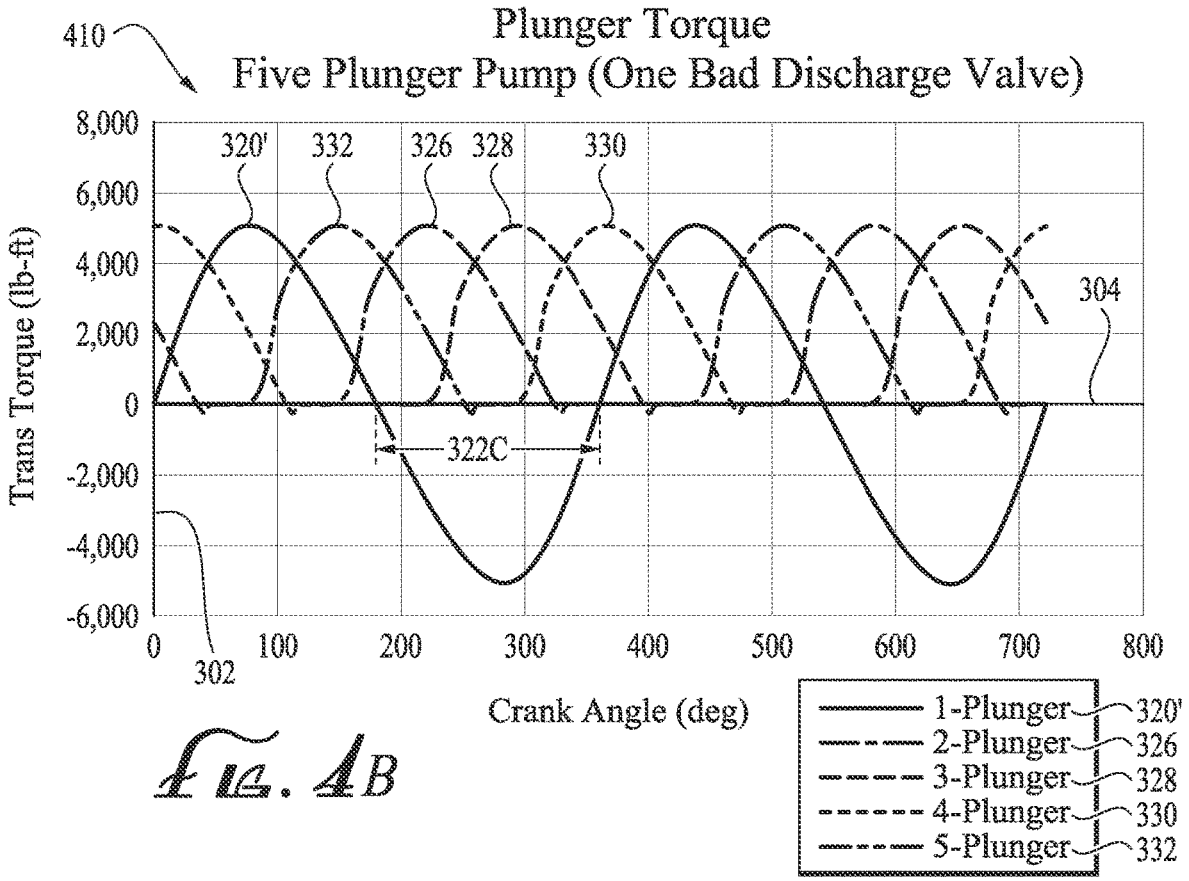

In accordance with the present disclosure, a degradation in the performance of one or more components of the pumping equipment 138 can be determined by the monitoring system via the torque as a function of crank angle curves as shown in FIGS. 3A, 3B, 4A, 4B, 5A, 5B, 6A, and 6B and/or the flow rate as a function of crank angle curves shown in FIGS. 5C, 5D, 6C, and 6D, collective referred to as FIGS. 3-6. In FIGS. 3-6, measured torque is provided in units of lb-ft, flow rate is in barrels per minute (bpm), and crank angle is in degrees (with 360 degrees representing a complete rotation of the crankshaft 210). FIGS. 3-5 are for a 5-plunger pump (i.e., a Quintuplex pump) with 4.5 inch diameter plungers having a 10 inch stroke and FIG. 6 is for a 3-plunger pump (i.e., a Triplex pump), with 4.5 inch diameter plungers having a 12 inch stroke. The torque and flow rate values were measured with the pump running at a 6 bpm pumping rate at 8000 psi discharge pressure. Torque measurements (Trans Torque) were obtained for torque on the transmission 148 output shaft, e.g., drive shaft 214 in FIG. 2.

Turning now to FIG. 4A, a torque profile plot 400 of cumulative torque a 5-plunger pump with a single damaged (e.g. leaking) discharge valve is described. In some embodiments, the exemplary torque profile plot 400 of FIG. 4A and plot 410 of FIG. 4B can be illustrative of the previous 5-plunger pump discussed with reference to FIG. 3A and FIG. 3B. However, FIG. 3 is with reference to a 5-plunger pump having 5 good discharge valves (e.g., non-leaking) in comparison to FIG. 4 with reference to a 5-plunger pump with a single damaged (e.g., leaking) discharge valve, e.g., a discharge valve 236 in a single chamber 224 of a five-chamber fluid end.

With reference to FIG. 4, the discharge valve 236 may be damaged (e.g., leaking) as a result of wear of abrasive fluid flowing through the discharge valve at high pressure. Additionally, or alternatively, the discharge valve may be damaged (e.g., leaking) as a result of debris in the source proppant material (e.g., dirty or contaminated proppant such as dirty or contaminated sand having undesirably large debris particles therein), for example when pumping a proppant-laden fracturing fluid. Such undesirably large particles may lodge within the discharge valve and prevent the discharge valve from properly closing during the suction stroke of the pump. In an aspect, such undesirably large particles may have a mean particle size about equal to or greater than the gap between the discharge valve sealing surface and discharge valve seat when the discharge valve is in a fully open position. In an aspect, such undesirably large particles may have an irregular shape (e.g., elongated), for example having a first dimension in at least one direct that is about equal to or greater than the gap between the discharge valve sealing surface and discharge valve seat when the discharge valve is in a fully open position and a second dimension in at least one direct that is about equal to or greater than the gap between the discharge valve sealing surface and discharge valve seat when the discharge valve is in a fully open position, such that the particle can enter the valve via the second dimension but cannot exit the valve and remains stuck, trapped, or lodged therein due to the first dimension. As such, large debris particle may prop or hold open the discharge valve and prevent the discharge valve from closing during the suction stroke, resulting in a leaking discharge valve. In an aspect, the undesirably large debris particles are formed of material other than sand, for example rocks, gravel, aggregate, ground aggregated set cement (e.g., ground concrete), ground tires, rubber, wood, sticks, etc. In an aspect, the undesirably large debris particles can have a mean particle size greater than sand. In an aspect, the undesirably large debris particles can have an average particle size (e.g., diameter) equal to or greater than 2, 2.5, 3, 3.5, 4, 4.5, 5, 5.5, 6, 6.5, 7, 7.5, 8, 8.5, 9, 10, 11, 12, 13, 14, 15, 16, 17, 18, 19, 20, 21, 22, 23, 24, 25, 30, 35, 40, 45, or 50 mm and less than about 60, 65, 70, 75, 80, 85, 90, 95, or 100 mm.

Referring to FIG. 4B, the torque curve 320' for plunger 1 having a damaged discharge valve is shown. When the discharge valve is damaged (e.g., propped/stuck open or otherwise prevented from fully closing/sealing, for example due to contamination of undesirably large particulate material (debris) in the proppant), the plunger 1 experiences negative torque during the suction stroke as shown by the negative value of portion 322C of torque curve 320' of FIG. 4B. Referring to FIG. 2, the negative torque shown at 322C is due to the presence of high-pressure fluid communication between discharge chamber 232 and pump chamber 224 through the damaged discharge valve 236, which in turn applies a force (e.g., reverse force or negative torque on the crankshaft 214) when plunger 212 is retracted (e.g., withdrawn) from the bore 218 during the suction stroke as the crankshaft 210 rotates from TDC to BDC for plunger 1. The cumulative effect of the negative torque shown at 322C between crank angles 180 to 360 of FIG. 4B is shown by the corresponding decrease in the cumulative torque curve 306 in the corresponding crank angle range of about 180 to about 360 degrees in FIG. 4A. Specifically, the cumulative torque curve 306 has a minimum value of about 2000 lb-ft of torque at a crank angle of about 300, and again at a crank angle of about 660 following a complete rotation of the crankshaft 210. The minimum value of about 2000 lb-ft of torque is associated with a net decrease in cumulative torque of about 5900 lb-ft in comparison to the maximum torque values of about 7900 lb-ft shown in curve 306 of FIG. 4A (e.g., 7900-2000=5900). As shown in FIGS. 3A, 4A, 5A, 5C, 6A, and 6C, the cumulative curves for torque and flow rate repeat in pattern over the 360-degree rotation cycles of crankshaft 210 corresponding to the suction and discharge strokes of the pumps.

In an embodiment such as shown in FIG. 4A, damage to a discharge valve is indicated by a net decrease in cumulative torque value (e.g., net decrease=max torque within a given 360 degree crank angle cycle-torque value at a given crank angle), as represented by the torque values of cumulative torque curve 306 across a range of crank angles (e.g., from about 180 to about 360), of equal to or greater than about 1000, 1500, 2000, 2500, 3000, 3500, 4000, 4500, 5000, 5500, or about 6000 lb-ft, or alternatively in a range of from about 1000, 1500, 2000, 2500, 3000, 3500, 4000, 4500, 5000, or 5500 to about 6000 lb-ft. In an embodiment such as shown in FIG. 4B, damage to a discharge valve associated with a given plunger is indicated by a negative torque value as represented by the torque values of a torque for a given plunger (e.g., portion 322C of curve 320' associated with a suction stroke across a range of crank angles of from about 180 to about 360) of less than about 0, −500, −1000, −1500, −2000, −2500, −3000, −3500, −4000, −4500, or −5000, or alternatively in a range of from about 0, −500, −1000, −1500, −2000, −2500, −3000, −3500, −4000, or −4500, to about −5000 lb-ft. In an aspect, the negative torque values can be determined for a given operating pressure (e.g., reference pressure) of the pump, for example 8000 psi for various of the embodiments disclosed herein with reference to the Figures, and other reference pressures and resultant negative torque values can be determined by a person of ordinary skill in the art for a given pump operating at a given reference pressure.

Figure 5A:
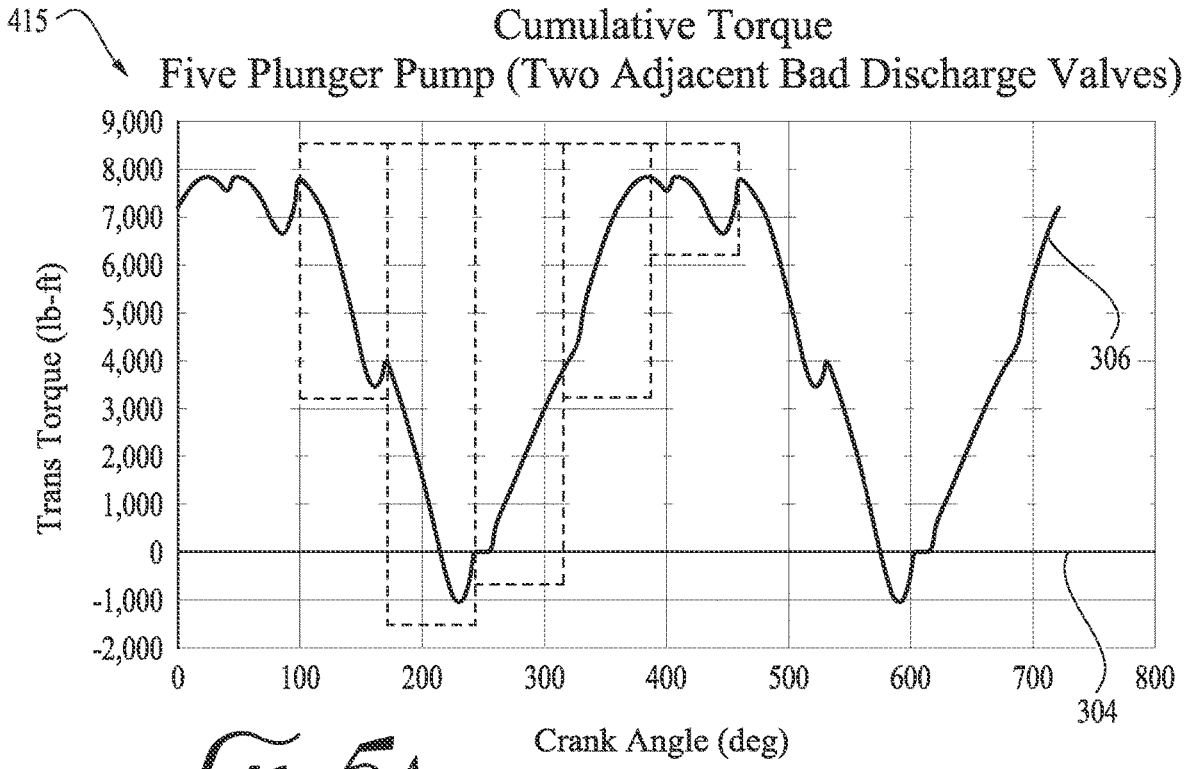
FIG. 5A-B are torque profile plots for a 5 cylinder pump with two damaged discharge valves according to an embodiment of the disclosure.
Figure 5B:
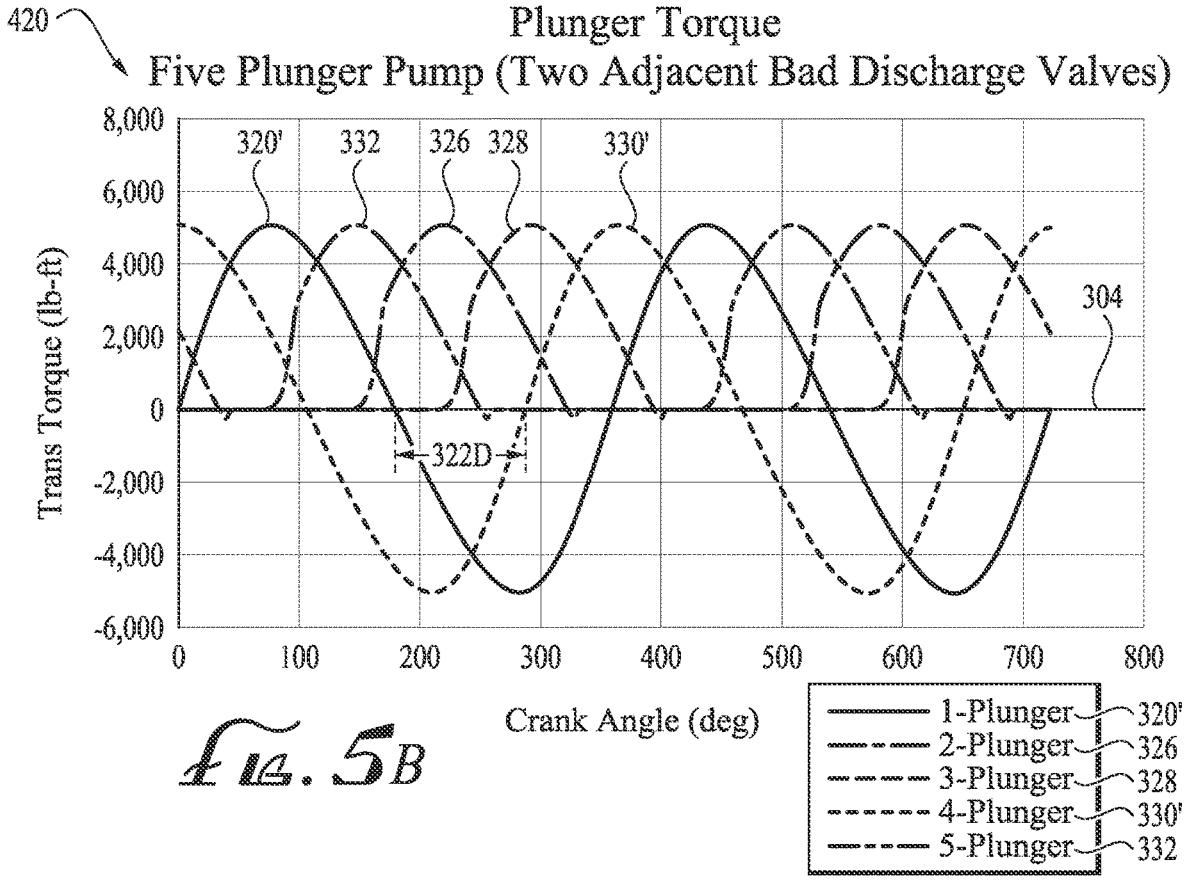

Referring to FIG. 5B, a torque profile plot 420 for individual plungers of a 5-plunger pump with two damaged (e.g. leaking) discharge valves associated with adjacently firing plungers is described. More specifically, the torque curve 320' for plunger 1 having a damaged discharge valve and torque curve 330' for adjacently firing plunger 4 having a damaged discharge valve are shown. As noted in the title of FIGS. 5A and 5B, the two damaged discharge valves (e.g., 1 and 4) are associated with plungers that are adjacent to each other in firing sequence (e.g., 1-5-2-3-4) of the discharge stroke. Stated alternatively, for a 5-plunger pump, the discharge stroke of two adjacently firing plungers having damaged discharge valves occurs within about 72 degrees of rotation of the crankshaft 210. When the discharge valves of adjacently firing plungers are damaged (e.g., stuck open for example due to contamination of undesirably large particulate material (debris) in the proppant), the plungers 1 and 4 experience negative torque during the suction stroke (as shown by the negative value of portion 322C of torque curve 320' of FIG. 4B and likewise for curves 320' and 330' of FIG. 5B). Referring to FIG. 2, the negative torque shown at 322C is due to the presence of high-pressure fluid communication between discharge chamber 232 and pump chamber 224 through the damaged discharge valve 236, which in turn applies a force (e.g., reverse force or negative torque) on the crankshaft 210 while plunger 212 is retracted (e.g., withdrawn) from the bore 218 during the suction stroke as the crankshaft 210 rotates from TDC to BDC for adjacently firing plungers 1 and 4. The cumulative effect of the negative torque shown at 322C between crank angles 180 to 360 for plunger 1 and between crank angles 108 and 288 for plunger 4 of FIG. 5B is shown by the corresponding decrease in the cumulative torque curve 306 in the corresponding crank angle range of about 100 to 250 degrees (alternatively, about 120 to about 225 degrees) in FIG. 5A. Specifically, the cumulative torque curve 306 has a zero or negative value in a crank angle range of from about 210 to about 240 degrees, and a minimum value of about −1000 lb-ft of torque at a crank angle of about 225, and repeating again at a crank angle range of from about 570 to about 600 degrees (with a minimum at about 585 degrees) following a complete rotation of the crankshaft 210. As shown in FIGS. 3A, 4A, 5A, 5C, 6A, and 6C, the cumulative curves for torque and flow rate repeat in pattern over the 360-degree rotation cycles of crankshaft 210 corresponding to the suction and discharge strokes of the pumps.

Referring to FIG. 5A, a cumulative torque profile plot 415 of a 5-plunger pump with two damaged (e.g. leaking) discharge valves is described. In an embodiment such as shown in FIG. 5A, damage to two discharge valves associated with adjacently firing plungers is indicated by a net decrease in cumulative torque value (e.g., net decrease=max torque within a given 360 degree crank angle cycle-torque value at a given crank angle), as represented by the torque values of cumulative torque curve 306 across a range of crank angles (e.g., from about 120 to about 225), of equal to or greater than about 6000, 6500, 7000, 7500, 8000, 8500, or 9000 lb-ft, or alternatively in a range of from about 6000, 6500, 7000, 7500, 8000, or 8500 to about 9000 lb-ft.

In an embodiment such as shown in FIG. 5A, damage to two discharge valves associated with adjacently firing plungers is indicated by the cumulative torque curve having a value of equal to or less than about zero, −100, −200, −300, −400, −500, −600, −700, −800, −900, −1000, −1100, −1200, −1300, −1400, −1500, −1600, −1700, −1800, −1900, −2000, −2500, −3000, −3500, −4000, −4500, −5000, −6000, −7000, −8000, −9000, or −10,000 lb-ft, for example in a crank angle range of from about 210 to about 250 degrees (alternatively from about 210 to about 240 degrees). In an embodiment such as shown in FIG. 5A, damage to two discharge valves associated with adjacently firing plungers is indicated by the cumulative torque curve having a value in a range of equal to or less than about zero to about −100, −200, −300, −400, −500, −600, −700, −800, −900, −1000, −1100, −1200, −1300, −1400, −1500, −1600, −1700, −1800, −1900, −2000, −2500, −3000, −3500, −4000, −4500, −5000, −6000, −7000, −8000, −9000, or −10,000 lb-ft, for example in a crank angle range of from about 210 to about 250 degrees (alternatively from about 210 to about 240 degrees). In an embodiment such as shown in FIG. 5A, damage to two discharge valves associated with adjacently firing plungers is indicated by the cumulative torque curve having a minimum torque value within a given 360-degree crank angle cycle of about −1000 lb-ft of torque, for example at a crank angle of about 225.

In an embodiment such as shown in FIG. 5B, damage to two discharge valves associated with adjacently firing plungers is indicated by overlapping negative torque value as represented by the torque values of a torque curves 320' and 330' for adjacently firing plungers 1 and 4, respectively (e.g., overlapped negative portions 322D associated with crank angles of from about 180 to about 288 degrees), wherein the overlapped negative torque values each are less than about 0, −500, −1000, −1500, −2000, −2500, −3000, −3500, −4000, −4500, or −5000, or alternatively each are in a range of from about 0, −500, −1000, −1500, −2000, −2500, −3000, −3500, −4000, or −4500, to about −5000. The overlap of negative torque values for the adjacently firing plungers (e.g., associated with a crank angle range of from about 180 to about 288 degrees) results in the significant summation of negative torque as indicated in cumulative torque curve 306 of FIG. 5A, and more specifically the sum of negative torque from the adjacently firing plungers is large enough to result in a net negative value for the cumulative torque curve 306 as discussed previously. As is discussed in more detail herein, the combined negative torque from the adjacently firing plungers resulting in a net negative value for the cumulative torque curve 306 has a significant negative effect on various components of the 5-plunger pumping system (e.g., mechanical linkages, connections, contact points, etc.) which can result in harmful wear and tear and possible damage to pumping system components during continued operation of the pump where negative torque values are repeated during 360 degree reciprocation of the plungers.

A pumping system, comprising: a pump fluid end comprising a plurality of pump chambers, each pump chamber comprising a bore having a reciprocatable plunger disposed therein, a suction valve, and a discharge valve; a prime mover mechanically coupled to the fluid end and configured to reciprocate the plungers; and a controller configured to alert a user (e.g., sound an alarm), initiate corrective action, or both in response to an indication of negative flow rate (e.g., in accordance with the discussion of FIGS. 5C, 5D, 6C, and 6D) from the pump during operation of the pumping system to pump a fluid. The indication of negative flow rate from the pump can comprise a negative flow rate value detected by a flow rate monitoring system comprising a flow rate sensor coupled to the pump fluid end or prime mover and provided to the controller during operation of the pumping system to pump a fluid. The negative flow rate value can be a function of rotational angle of the crankshaft as the crankshaft rotates 360 degrees during reciprocation (e.g., a suction and discharge stroke) of the plunger. The negative flow rate value can repeat itself during each successive 360-degree rotation of the crankshaft. The negative flow rate value can be, for example, in a range of less than zero to about −10 bpm.

Figure 5C:
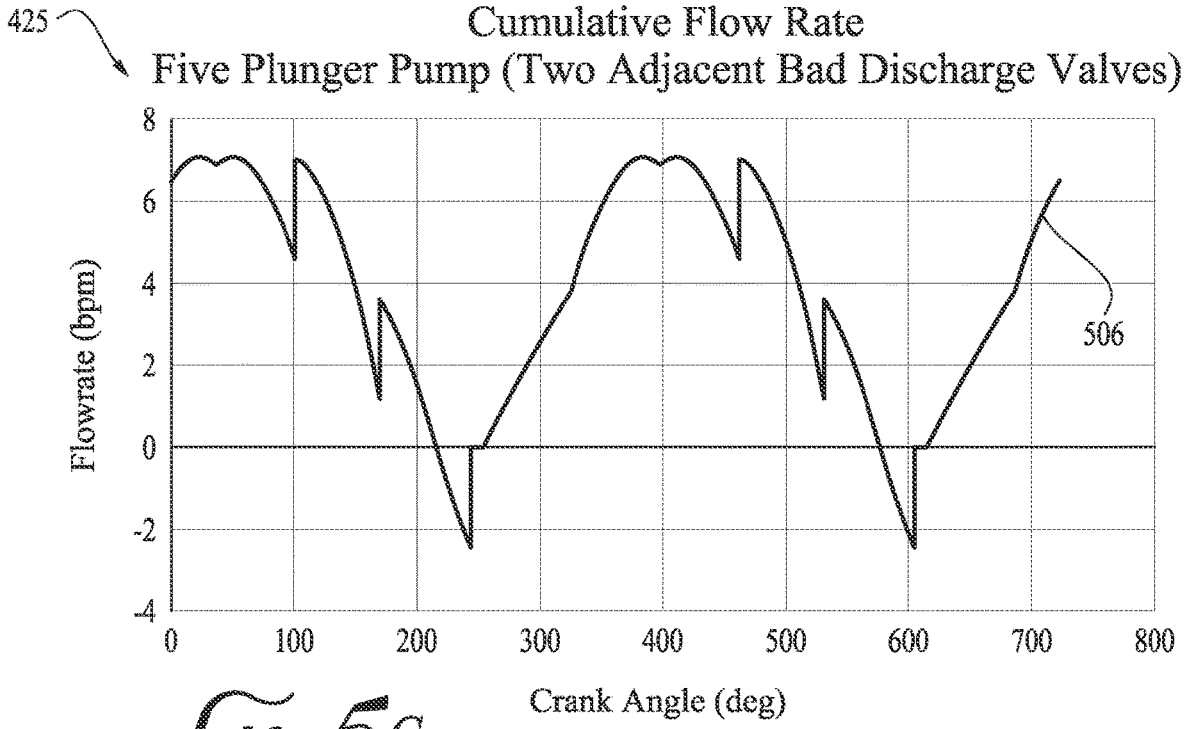
FIG. 5C-D are flow profile plots for a 5 cylinder pump with two damaged valves according to an embodiment of the disclosure.
Figure 5D:
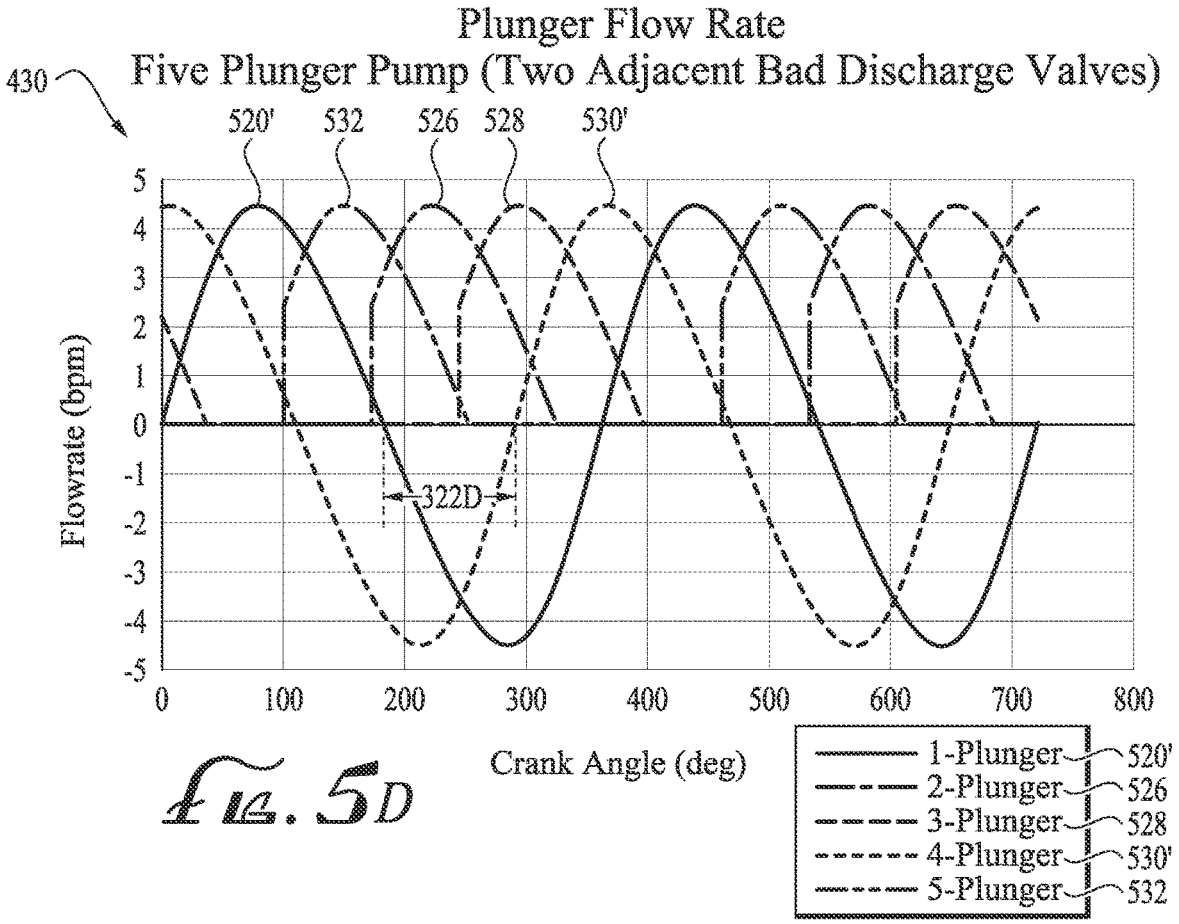

Referring to FIG. 5C, a cumulative flow rate profile plot 425 of a 5-plunger pump with two damaged (e.g. leaking) discharge valves associated with adjacently firing plungers is described. Referring to FIG. 5D, a flow rate profile plot 430 for individual plungers of a 5-plunger pump (e.g., as measured by fluid sensor 264 in discharge line 230) with two damaged (e.g. leaking) discharge valves associated with adjacently firing plungers is described. FIGS. 5C and D correspond to the flow rate in barrels per minute (bpm) as a function of crank angle in degrees (deg) of a 5-plunger pump having a damaged (e.g., leaking) valve on adjacently firing plungers/chambers of the pump of the type discussed herein with reference to FIGS. 5A and 5B. Referring to FIG. 5D, the flow rate curve 520' for plunger 1 having a damaged (e.g., leaking) discharge valve and flow rate curve 530' for adjacently firing plunger 4 having a damaged (e.g., leaking) discharge valve are shown. As noted in the title of FIGS. 5C and 5D, the two damaged discharge valves are associated with plungers that are adjacent to each other in firing sequence of the discharge stroke (e.g., discharge valves associated with adjacently firing plungers). Stated alternatively, for a 5-plunger pump, the discharge stroke of two adjacently firing plungers having damaged discharge valves occurs within about 72 degrees of rotation of the crankshaft 210. When the discharge valves of adjacently firing plungers are damaged (e.g., stuck open for example due to contamination of undesirably large particulate material (debris) in the proppant), the adjacently firing plungers 1 and 4 experience negative flow rate during the suction stroke as shown by the negative portion of flow rate curves 520' and 530' of FIG. 5D. Referring to FIG. 2, the negative flow rate shown is due to the presence of high-pressure fluid communication between discharge chamber 232 and pump chamber 224 through the damaged discharge valve 236, which in turn allows for the reverse flow of fluids (e.g., negative flow rate) from the discharge chamber 232 through the damaged discharge valve 236 and into chamber 224 and bore 218 during the suction stroke as the crankshaft 210 rotates from TDC to BDC for adjacently firing plungers 1 and 4. Stated alternatively, the net flow rate from adjacently firing plungers 1 and 4 each having a damaged discharge valve is zero summed over a 360 degree suction and discharge stroke of each damaged plunger (e.g., the adjacently firing plungers having damaged discharge valves are merely pushing the same volume of fluid back and forth across the open discharge valve during the suction and discharge strokes). The cumulative effect of the negative flow rate between crank angles 180 to 360 for plunger 1 and between crank angles 108 and 288 for plunger 4 of FIG. 5D is shown by the corresponding decrease in the cumulative flow rate curve 506 in the corresponding crank angle range of about 100 to 250 degrees in FIG. 5C. Specifically, the cumulative flow rate curve has a zero or negative value in a crank angle range of from about 210 to about 260 degrees, and a minimum value of about −2.5 bpm at a crank angle of about 240, and repeating again at a crank angle range of from about 570 to about 620 degrees (with a minimum at about 600 degrees) following a complete rotation of the crankshaft 210. As shown in FIGS. 3A, 4A, 5A, 5C, 6A, and 6C, the cumulative curves for torque and flow rate repeat in pattern over the 360-degree rotation cycles of crankshaft 210 corresponding to the suction and discharge strokes of the pumps.

In an embodiment such as shown in FIG. 5C, damage to two discharge valves associated with adjacently firing plungers is indicated by a net decrease in cumulative flow rate value (e.g., net decrease=max flow rate within a given 360 degree crank angle cycle-flow rate value at a given crank angle), as represented by the flow rate values of cumulative flow rate curve 506 across a range of crank angles (e.g., from about 180 to about 240), of equal to or greater than about 4, 4.5, 5, 5.5, 6, 6.5, 7, 7.5, 8, 8.5, or 9 bpm alternatively in a range of from about 4, 4.5, 5, 5.5, 6, 6.5, 7, 7.5, 8, or 8.5 to about 9 bpm.

In an embodiment such as shown in FIG. 5C, damage to two discharge valves associated with adjacently firing plungers is indicated by the cumulative flow rate curve 506 having a value of equal to or less than about zero, −0.25, −0.5, −0.75, −1, −1.25, −1.5, −1.75, −2, −2.25, −2.5, −2.75, −3, −4, −5, −6, −7, −8, −9, −10, −11, −12, −13, −14, −15, −16, −17, −18, −19, −20, −25, −30, −35, −40, −45, −50, −60, −70, −80, −90, or −100 bpm, for example in a crank angle range of from about 210 to about 260 degrees. In an embodiment such as shown in FIG. 5C, damage to two discharge valves associated with adjacently firing plungers is indicated by the cumulative flow rate curve 506 having a value in a range of equal to or less than about zero to about −0.25, −0.5, −0.75, −1, −1.25, −1.5, −1.75, −2, −2.25, −2.5, −2.75, −3, −4, −5, −6, −7, −8, −9, −10, −11, −12, −13, −14, −15, −16, −17, −18, −19, −20, −25, −30, −35, −40, −45, −50, −60, −70, −80, −90, or −100 bpm, for example in a crank angle range of from about 210 to about 260 degrees. In an embodiment such as shown in FIG. 5C, damage to two discharge valves associated with adjacently firing plungers is indicated by the cumulative flow rate curve 506 having a minimum flow rate value within a given 360-degree crank angle cycle of about −2.5 bpm, for example at a crank angle of about 240. In an aspect, the negative flow rate values can be determined for a given operating pressure (e.g., reference pressure) of the pump, for example 8000 psi for various of the embodiments disclosed herein with reference to the Figures, and other reference pressures and resultant negative flow rate values can be determined by a person of ordinary skill in the art for a given pump operating at a given reference pressure.

In an embodiment such as shown in FIG. 5D, damage to two discharge valves associated with adjacently firing plungers is indicated by overlapping negative flow rate value as represented by the flow rate values of a flow rate curves 520' and 530' for adjacently firing plungers (e.g., overlapped negative portions 322D associated with crank angles of from about 180 to about 288 degrees), wherein the overlapped negative flow rate values each are less than about 0, −1, −2, −3, −4, −5, −6, −7, −8, −9, −10, −11, −12, −13, −14, −15, −16, −17, −18, −19, −20, −25, −30, −35, −40, −45, −50, −60, −70, −80, −90, or −100 bpm, or alternatively each are in a range of from about 0, −1, −2, −3, −4, −5, −6, −7, −8, −9, −10, −11, −12, −13, −14, −15, −16, −17, −18, −19, −20, −25, −30, −35, −40, −45, −50, −60, −70, −80, or −90 to about −100 bpm. The overlap of negative flow rate values for the adjacently firing plungers (e.g., associated with a crank angle range of from about 180 to about 288 degrees) results in the significant summation of negative flow rate as indicated in FIG. 5C, and more specifically the sum of negative flow from the adjacently firing plungers is large enough to result in a net negative value for the cumulative flow rate curve 506 as discussed previously. As is discussed in more detail herein, the combined negative flow rate from the adjacently firing plungers resulting in a net negative value for the cumulative flow rate curve 506 has a significant negative effect on various components of the pumping system (e.g., mechanical linkages, connections, contact points, etc.) from increased vibration from pulsations in the flow rate which can result in harmful wear and tear and possible damage to pumping system components during continued operation of the pump where negative flowrate values are repeated during repeated 360 degree reciprocation of the plungers. The vibration from flowrate pulsations can affect the fatigue life of the high pressure lines between the pump and the wellhead and the pulsations can have detrimental effects on the reservoir during a well treatment. In an aspect, the combination of negative cumulative torque (see, e.g., FIG. 5A) and negative cumulative flow rate (see, e.g., FIG. 5C) can result in oscillations in the prime mover (e.g., oscillations in RPM of a combustion engine or electric motor) that can likewise result in harmful wear and tear (e.g., shorter component life) and possible damage to pumping system components during continued operation of the pump.

In contrast to FIGS. 3-5 related to a 5-plunger pump, FIG. 6 is related to a 3-plunger pump. Referring to FIG. 6B, which is a plot 440 of torque vs. crank angle for individual plungers of a 3-plunger pump, namely the torque curve 620' for plunger 1 having a damaged discharge valve and torque curves 632 for plunger 2 and 630 for plunger 3 having non-damaged discharge valves are shown. When the discharge valve of a single plunger of a 3-plunger pump (i.e., plunger 1) is damaged (e.g., stuck open for example due to contamination of undesirably large particulate material (debris) in the proppant), the plunger 1 experiences negative torque during the suction stroke as shown by the negative value of portion 322C of torque curves 620' of FIG. 6B. Referring to FIG. 2, the negative torque shown at 322C is due to the presence of high-pressure fluid communication between discharge chamber 232 and pump chamber 224 through the damaged discharge valve 236, which in turn applies a force (e.g., reverse force and resultant negative torque) on the crankshaft 210 while plunger 212 is retracted (e.g., withdrawn) from the bore 218 during the suction stroke as the crankshaft 210 rotates from TDC to BDC for plunger 1. The effect of the negative torque shown at 322C between crank angles 180 to 360 for plunger 1 is shown by the corresponding decrease in the cumulative torque curve 606 in the corresponding crank angle range of about 180 to 240 degrees in FIG. 6A. Specifically, the cumulative torque curve has a zero or negative value in a crank angle range of from about 240 to about 320 degrees, and a minimum value of about −1200 lb-ft of torque at a crank angle of about 260, and repeating again at a crank angle range of from about 600 to about 680 degrees (with a minimum at about 620 degrees) following a complete rotation of the crankshaft 210. As shown in FIGS. 3A, 4A, 5A, 5C, 6A, and 6C, the cumulative curves for torque and flow rate repeat in pattern over the 360-degree rotation cycles of crankshaft 210 corresponding to the suction and discharge strokes of the pumps.

Figure 6A:
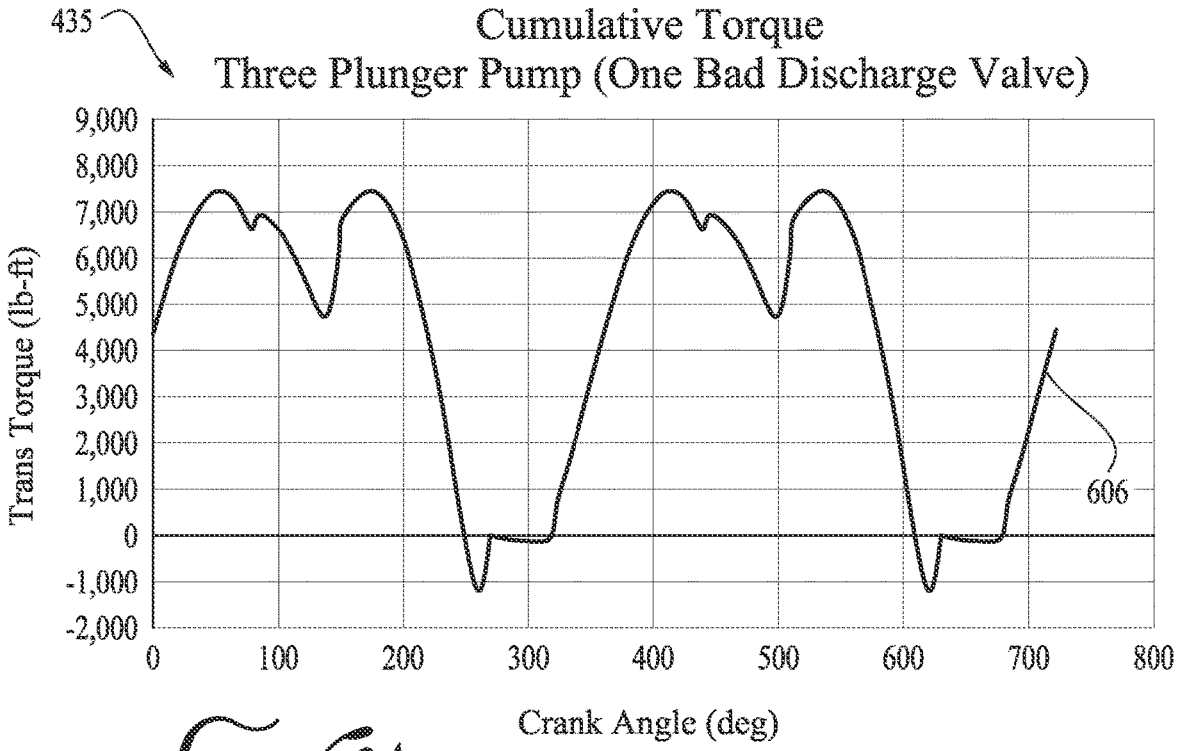
FIG. 6A-B are torque profile plots for a 3 cylinder pump with one damaged discharge valve according to an embodiment of the disclosure.

Referring to FIG. 6A, a cumulative torque profile plot 435 of a 3-plunger pump with one damaged (e.g. leaking) discharge valve is described. In an embodiment such as shown in FIG. 6A, damage to a discharge valve associated with a single plunger in a 3-plunger pump is indicated by a net decrease in cumulative torque value (e.g., net decrease=max torque within a given 360 degree crank angle cycle-torque value at a given crank angle), as represented by the torque values of cumulative torque curve 606 across a range of crank angles (e.g., from about 180 to about 240), of equal to or greater than about 2500, 3000, 3500, 4000, 4500, 5000, 5500, 6000, 6500, 7000, 7500, 8000, 8500, or 9000 lb-ft, or alternatively in a range of from about 2500, 3000, 3500, 4000, 4500, 5000, 5500, 6000, 6500, 7000, 7500, 8000, or 8500 to about 9000 lb-ft.

In an embodiment such as shown in FIG. 6A, damage to a discharge valve associated with single plunger in a 3-plunger pump is indicated by the cumulative torque curve 606 having a value of equal to or less than about zero, −100, −200, −300, −400, −500, −600, −700, −800, −900, −1000, −1100, −1200, −1300, −1400, −1500, −1600, −1700, −1800, −1900, −2000, −2500, −3000, −3500, −4000, −4500, −5000, −6000, −7000, −8000, −9000, or −10,000 lb-ft, for example in a crank angle range of from about 240 to about 320 degrees. In an embodiment such as shown in FIG. 6A, damage to a discharge valve associated with single plunger in a 3-plunger pump is indicated by the cumulative torque curve 606 having a value in a range of equal to or less than about zero to about −100, −200, −300, −400, −500, −600, −700, −800, −900, −1000, −1100, −1200, −1300, −1400, −1500, −1600, −1700, −1800, −1900, −2000, −2500, −3000, −3500, −4000, −4500, −5000, −6000, −7000, −8000, −9000, or −10,000 lb-ft, for example in a crank angle range of from about 240 to about 320 degrees. In an embodiment such as shown in FIG. 6A, damage to a discharge valve associated with single plunger in a 3-plunger pump is indicated by the cumulative torque curve having a minimum torque value within a given 360-degree crank angle cycle of about −1200 lb-ft of torque, for example at a crank angle of about 260. The negative torque values for the single plunger (e.g., associated with a crank angle range of from about 180 to about 360 degrees) results in the significant summation of negative torque as indicated in FIG. 6A, and more specifically the effect of the negative torque from the single plunger is large enough to result in a net negative value for the cumulative torque curve 606 as discussed previously. As is discussed in more detail herein, the negative torque from the single plunger resulting in a net negative value for the cumulative torque curve 606 has a significant negative effect on various components of the 3-plunger pumping system (e.g., mechanical linkages, connections, contact points, etc.) which can result in harmful wear and tear and possible damage to pumping system components during continued operation of the pump where negative torque values are repeated during 360 degree reciprocation of the plungers.

Figure 6B:
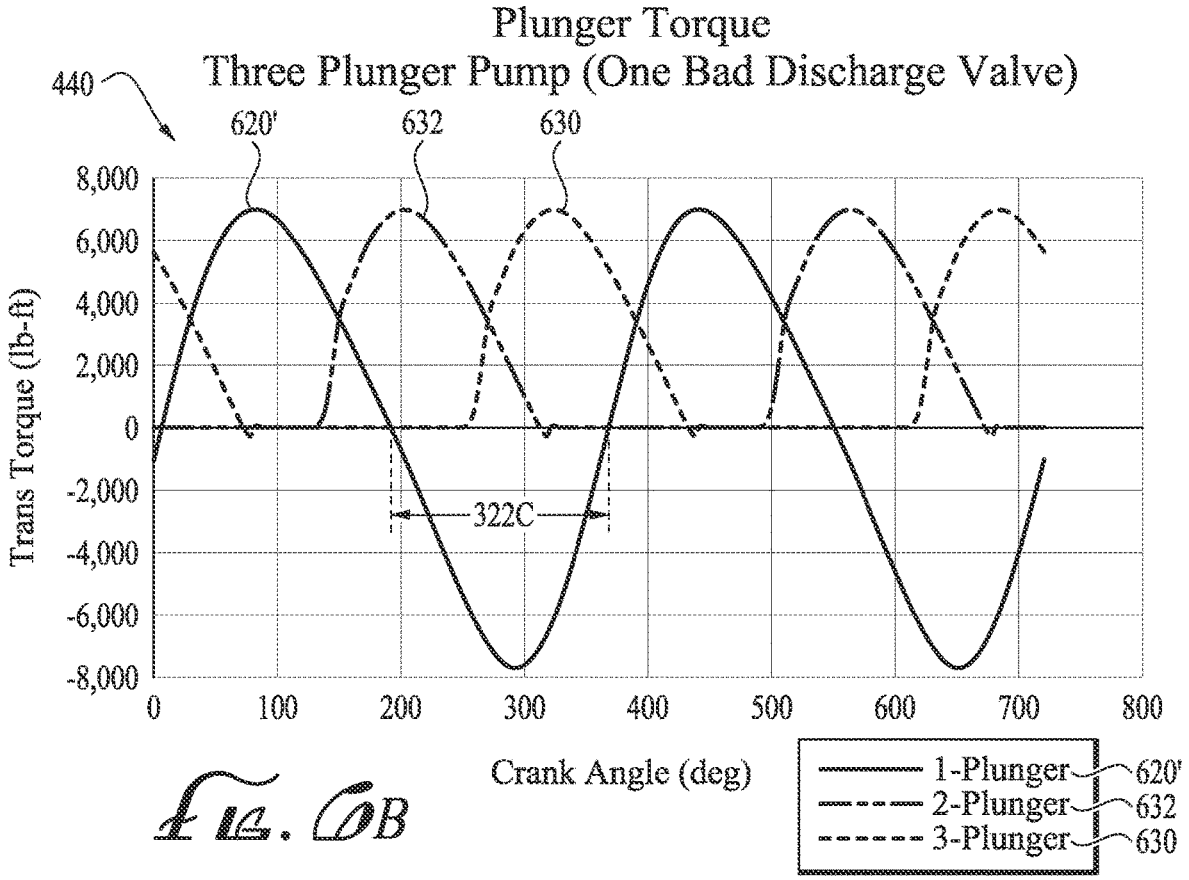
Figure 6C:
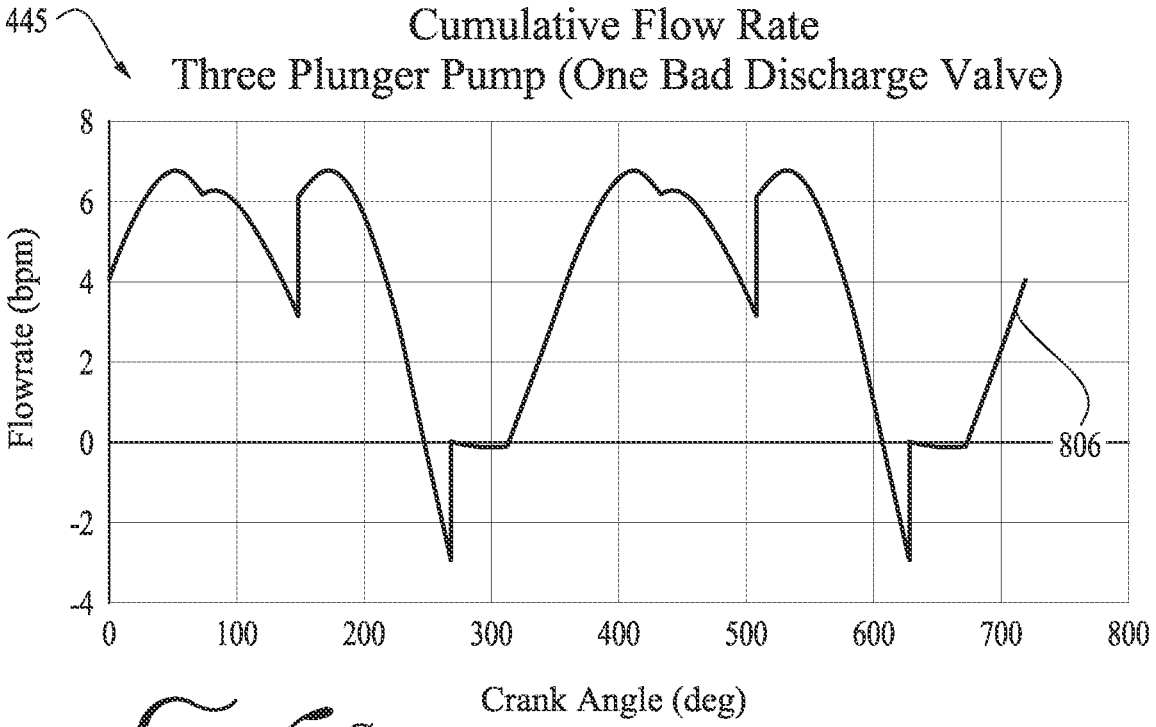
FIG. 6C-D are flow profile plots for a 3 cylinder pump with one damaged discharge valve according to an embodiment of the disclosure.
Figure 6D:
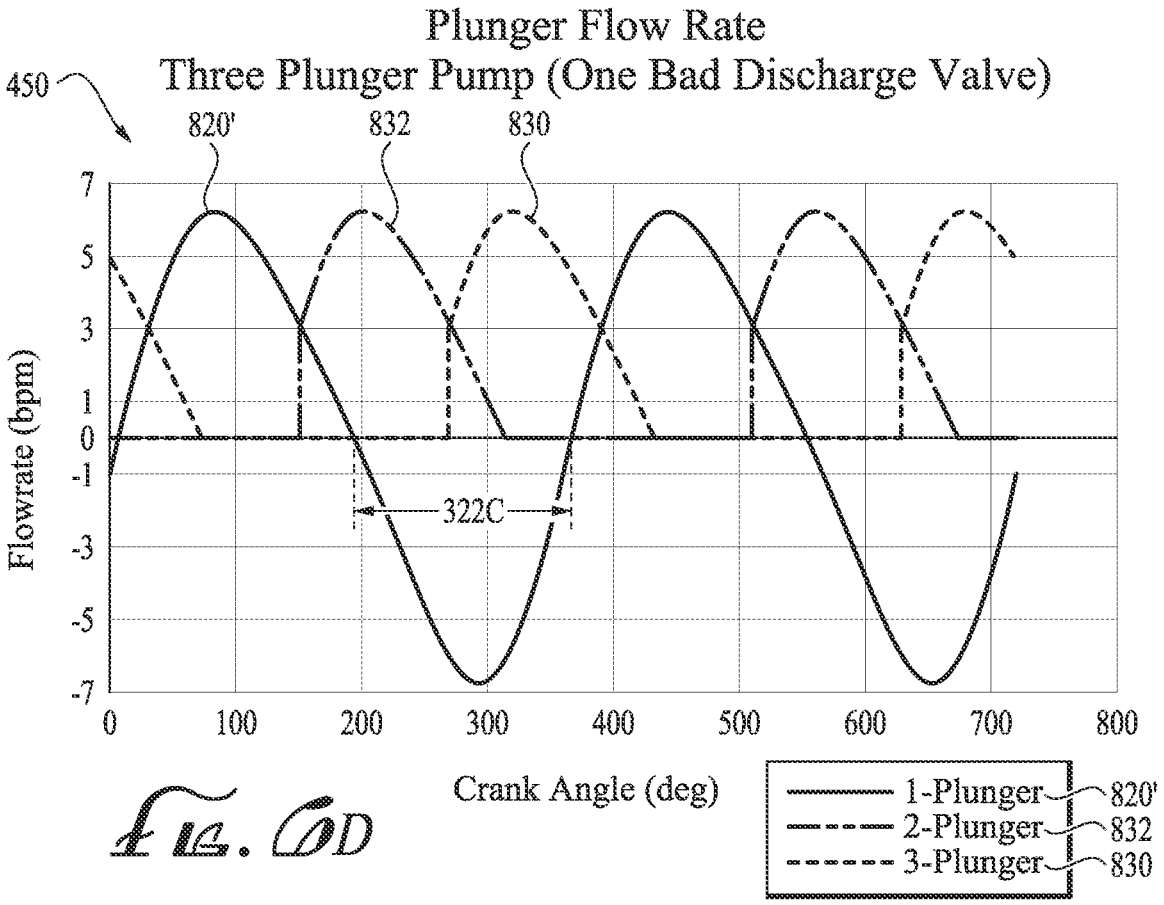

FIGS. 6C and 6D correspond to the flow rate in barrels per minute (bpm) as a function of crank angle in degrees (deg) of a 3-plunger pump having a bad discharge valve on a single chamber (i.e., plunger 1) of the pump of the type discussed herein with reference to FIGS. 6A and 6B. Referring to FIG. 6D, the flow rate curve 820' for plunger 1 having a damaged discharge valve and flow rates curves 832 for plunger 2 and 830 for plunger 3 having non-damaged discharge valves are shown. When the discharge valve of single plunger of a 3-plunger pump (i.e., plunger 1) is damaged (e.g., stuck open for example due to contamination of undesirably large particulate material in the proppant), the plunger 1 experiences negative flow rate during the suction stroke as shown by the negative value of portion 322C of flow rate curve 820'*of* FIG. 6D. Referring to FIG. 2, the negative flow rate shown at 322C is due to the presence of high-pressure fluid communication between discharge chamber 232 and pump chamber 224 through the damaged discharge valve 236, which in turn allows for the reverse flow of fluids (e.g., negative flow rate) from the discharge chamber 232 through the damaged discharge valve 236 and into chamber 224 and bore 218 during the suction stroke as the crankshaft 210 rotates from TDC to BDC for plunger 1. Stated alternatively, the net flow rate from plunger 1 having a damaged discharge valve is zero summed over a 360 degree suction and discharge stroke of damaged plunger 1 (e.g., the plunger having a damaged discharge valve is merely pushing the same volume of fluid back and forth across the open discharge valve during the suction and discharge strokes). The cumulative effect of the negative flow rate shown at 322C between crank angles 180 to 360 for plunger 1 of FIG. 6D is shown by the corresponding decrease in the cumulative flow rate curve 806 in the corresponding crank angle range of about 180 to 260 degrees in FIG. 6C. Specifically, the cumulative flow rate curve has a zero or negative value in a crank angle range of from about 260 to about 320 degrees, and a minimum value of about −3 bpm at a crank angle of about 260 degrees, and repeating again at a crank angle range of from about 620 to about 680 degrees (with a minimum at about 620 degrees) following a complete rotation of the crankshaft 210. As shown in FIGS. 3A, 4A, 5A, 5C, 6A, and 6C, the cumulative curves for torque and flow rate repeat in pattern over the 360-degree rotation cycles of crankshaft 210 corresponding to the suction and discharge strokes of the pumps.

In an embodiment such as shown in FIG. 6C, damage to a discharge valve associated with single plunger in a 3-plunger pump is indicated by the cumulative flow rate curve 806 having a value of equal to or less than about zero, −1, −2, −3, −4, −5, −6, −7, −8, −9, −10, −11, −12, −13, −14, −15, −16, −17, −18, −19, −20, −25, −30, −35, −40, −45, −50, −60, −70, −80, −90, or −100 bpm, for example in a crank angle range of from about 260 to about 320 degrees. In an embodiment such as shown in FIG. 6A, damage to a discharge valve associated with single plunger in a 3-plunger pump is indicated by the cumulative flow rate curve 806 having a value in a range of equal to or less than about zero to about −1, −2, −3, −4, −5, −6, −7, −8, −9, −10, −11, −12, −13, −14, −15, −16, −17, −18, −19, −20, −25, −30, −35, −40, −45, −50, −60, −70, −80, −90, or −100 bpm, for example in a crank angle range of from about 260 to about 320 degrees. In an embodiment such as shown in FIG. 6A, damage to a discharge valve associated with single plunger in a 3-plunger pump is indicated by the cumulative flow rate curve having a minimum flow rate value within a given 360-degree crank angle cycle of about −3 bpm, for example at a crank angle of about 260 degrees.

The negative flow rate values for the single plunger (e.g., associated with a crank angle range of from about 180 to about 360 degrees in FIG. 6D) results in the significant cumulative negative flow rate as indicated in FIG. 6C, and more specifically the effect of the negative flow from the single plunger is large enough to result in a net negative value for the cumulative flow rate curve 806 as discussed previously. As is discussed in more detail herein, the negative flow rate from the single plunger resulting in a net negative value for the cumulative flow rate curve 806 has a significant negative effect on various components of the pumping system (e.g., mechanical linkages, connections, contact points, etc.) from increased vibration from pulsations in the flow rate which can result in harmful wear and tear and possible damage to pumping system components during continued operation of the pump where negative flowrate values are repeated during repeated 360 degree reciprocation of the plungers. The vibration from flowrate pulsations can affect the fatigue life of the high pressure lines between the pump and the wellhead and the pulsations can have detrimental effects on the reservoir during a well treatment. In an aspect, the combination of negative cumulative torque (see, e.g., FIG. 6A) and negative cumulative flow rate (see, e.g., FIG. 6C) can result in oscillations in the prime mover (e.g., oscillations in RPM of a combustion engine or electric motor) that can likewise result in harmful wear and tear (e.g., shorter component life) and possible damage to pumping system components during continued operation of the pump.

A pumping system, comprising: a pump fluid end comprising a plurality of pump chambers, each pump chamber comprising a bore having a reciprocatable plunger disposed therein, a suction valve, and a discharge valve; a prime mover mechanically coupled to the fluid end [by a drivetrain] and configured to reciprocate the plungers; and a controller communicatively coupled to the prime mover, the fluid end, or both and configured to alert a user (e.g., sound an alarm) re a pump malfunction, initiate corrective action of the pump malfunction, or both in response to an indication of leakage (e.g., in accordance with the discussion of FIGS. 5 and 6) of (i) a single discharge valve in a 3-plunger pump or (ii) discharge valves associated with two plungers in adjacent/successive firing order (e.g., firing order is the sequential order in which the plungers are reciprocated from a fully retracted position at the end of a suction stroke to a fully extended position at the end of a discharge stroke). The indication of leakage of a single discharge valve in a 3-plunger pump can comprise the condition of each discharge valve in the 3-plunger pump detected by valve-leakage monitoring system comprising a valve-leakage sensor (e.g., vibration sensor or accelerometer) coupled to the pump fluid end or prime mover and provided to the controller during operation of the pumping system to pump a fluid. The indication of leakage can be a result of the discharge valve being propped open by debris in the fluid during a discharge stroke of the plunger (e.g., the debris obstructing/preventing complete closure of the discharge valve). The indication of leakage of discharge valves associated with two plungers in adjacent/successive firing order can comprise the condition of each discharge valve in a 5-plunger pump detected by valve-leakage monitoring system comprising a valve-leakage sensor (e.g., vibration sensor or accelerometer) coupled to the pump fluid end or prime mover and provided to the controller during operation of the pumping system to pump a fluid. The indication of leakage can be a result of the discharge valves being propped open by debris in the fluid during a discharge stroke of the plunger (e.g., the debris obstructing/preventing complete closure of the discharge valve).

As discussed herein, when discharge valves leak on positive displacement pumps, the variation of torque on the pump increases. Severe leakage of one valve on a 3-plunger pump or two valves adjacent in firing order on a 5-plunger pump can cause complete torque reversal that accelerates fatigue life consumption of all drivetrain components from the motor/engine to the pump power end. This results in more failures and higher maintenance costs. The presently disclosed systems and methods advantageously alert an operator and/or control (e.g., automatically) an operating parameter of a pumping system (e.g., pump rate, pump start/stop) to avoid undesired wear and tear and possible damage to one or more component (e.g., drivetrain components) of the pumping equipment. For example, when torque goes negative, the gear teeth in both the transmission and pump speed reducer are now loaded on the opposite side of the teeth. This causes slight back and forth bending of the gear teeth (as torque oscillates from negative to positive) which will accelerate the consumption of the gear teeth life. In addition to bending back and forth, any slack in the gear teeth engagement will cause impact loading on the gear teeth at each torque reversal (e.g., each time torque changes from positive to negative to positive to negative, etc. during cyclic rotation of the crankshaft during suction and discharge strokes of the plungers). Likewise, when flow rate goes negative increased vibration from pulsations in the flowrate can result in harmful wear and tear and possible damage to pumping system components. The vibration from flowrate pulsations can affect the fatigue life of the high pressure lines between the pump and wellhead. The flow pulsations can have detrimental effects on the reservoir during a well treatment.

The systems and methods described herein can be used in any pumping operation as described herein. In an embodiment, the systems and method described therein are used in a hydraulic fracturing operation. For example, the pumping unit 110 can be part of a typical fracturing fleet comprising a plurality of pumping units fluidically couple to a wellbore via a manifold and working in concert to place a proppant slurry into a subterranean formation. Turning now to FIG. 7, an exemplary fracturing fleet is described. The fracturing fleet 500 can comprise a plurality of pumping units 522 (also referred to as fracturing pumps or high horsepower pumps) fluidically coupled to a fluid network 524 (also referred to as a "missile" or manifold) to provide fracturing fluids to the wellbore of a treatment well 530, e.g., wellbore 112 of FIG. 1. The pumping units 522 can be an embodiment of the pumping unit 110 with the pumping equipment 138 of FIG. 1 comprising the unit controller 140, a VFD (if electrically driven), the prime mover 146 and the pump 144 of FIG. 2. Although 8 pumping units, e.g., pumping unit 522A-H, are illustrated fluidically coupled to the fluid network 524, it is understood that 2, 3, 4, 5, 6, 7, 8, 9, 10, 11, 12, or any number of pumping units 522 can be fluidically coupled to the fluid network 524.

The treatment fluid, e.g., fracturing fluid, can be blended by various pumping equipment of the fracturing fleet and delivered to the plurality of pumping units 522 by the fluid network 524. The fracturing fluids are typically a blend of friction reducer and water, e.g., slick water, with some concentration of proppant, e.g., sand. In some cases, a carrier fluid (e.g., water, a gelling agent, optionally a friction reducer, and/or other additives) may be created in a hydration blender 514 from the water supply unit 512 and gelling chemicals from the chemical unit 516. When slick water is used, the hydration blender 514 can be omitted. The proppant is added at a controlled rate to the carrier fluid or slick water in a mixing blender 520 that is fluidically coupled to the fluid network 524. The treatment fluid can be distributed to the pumping units 522A-H via the supply line 228 (as shown in FIG. 2) that is fluidically coupled to the low pressure side of the fluid network 524. The fluid treatment can be pressured by the pumping units 522A-H and returned to the high pressure side of the fluid network 524 via high pressure line 230 (as shown in FIG. 2) for delivery to the wellbore, e.g., wellbore 112, of the treatment well 530 via high pressure line 538. Although fracturing fluids typically contain a proppant, a portion of the pump schedule may include one or more treatment fluids without proppant (sometimes referred to as a pad fluid). In some scenarios, the treatment fluid can be blended with an acid to produce an acid fracturing fluid, for example, pumped as part of a spearhead or acid stage that clears debris that may be present in the wellbore and/or fractures to help clear the way for fracturing fluid to access the fractures and surrounding formation, e.g., formation 132 of FIG. 1.

A control van 510 can be communicatively coupled (e.g., via a wired or wireless network) to the fracturing fleet, e.g., plurality of pumping units 522A-H. A managing process 536 executing on computer system 532 within the control van 510 can establish unit level control over the various equipment of the fracturing fleet including the plurality of pumping units 522A-H, the blender 520, the proppant storage 518, the water supply unit 512, the hydration blender 514, the chemical unit 516, and various sensors and remote operated valves within the fluid network 524. The managing process 536 can direct the pumping operation and receive periodic datasets indicative of the pumping operation.

In some scenarios, the managing process 536 can direct the pumping operation via the unit controller 140 on each of the plurality of pumping units 522A-E while receiving a continuous or periodic data stream of datasets from sensors on the pumping unit, or from the VFD, when present. In some embodiments, the managing process 536 within the control van 510 can be communicatively coupled to the unit controller, e.g., unit controller 140 of FIG. 1-3 and direct the pumping operation via the unit controller. The unit controller 140 can communicate the instructions to the unit controller 140 to the monitor and control the pumping process (e.g., a pumping schedule for a given stage of a fracturing job). In some embodiments, the monitoring process executing on the unit controller, e.g., unit controller 140, can alert the managing process 536 of one or more pump conditions. In some embodiments, the monitoring process executing on the computer system 532 can alert the managing process 536 of one or more pump conditions.

Although the managing process 536 and monitoring process are described as executing on a computer system 532, it is understood that the computer system 532 can be any form of a computer system such as a server, a workstation, a desktop computer, a laptop computer, a tablet computer, a smartphone, or any other type of computing device. The computer system 532 can include one or more processors, memory, input devices, and output devices, as described in more detail further hereinafter.

In an embodiment, the monitoring process can alert the service crew, the managing process 536, or both of a health status of one or more pumping units. For example, the monitoring process may determine a "poor" health status for the pump equipment of pumping unit 522A in response to the parameters of pumping unit 522A. In some embodiments, the managing process 536 may slow the pump rate of pumping unit 522A by decreasing the engine/motor speed. For example, the monitoring process may identify discharge valve leakage as the source of the "poor" health status of the pumping unit 522A and the discharge valve leakage condition may diminish or disappear in response to slowing the pumping speed. In some embodiments responsive to an indication of discharge valve leakage, negative torque, or negative flow rate, the managing process 536 may cease pumping operation of the pumping unit 522A and isolate the pumping unit 522A from the fluid network 524 or replace the pumping unit 522A with a fresh pumping unit held in reserve. In some embodiments, the managing process 536 may redistribute the pumping load, e.g., flowrate, to the remaining pumping units 522B-H. In some embodiments, the managing process 536 may distribute the pumping load of pumping unit 522A to the replacement pumping unit.

The computer system at the wellsite may be a computer system suitable for communication and control of the pumping equipment, e.g., a fracturing fleet 500 comprising a plurality of pumping units 120. The pumping operation described in FIG. 7 can be directed by a controller within the control van 510 that establishes control over each of the unit controllers, e.g., unit controller 140 of FIG. 1, and thus, establishes control of the pumping operations. A managing process can be executing on a processor within the control van 510, the computer system 532, the unit controller 140, a networked computer system, a remote computer system, a virtual computer system, a cloud platform, or combinations thereof. In some embodiments, the controller within the computer system 532 of FIG. 7 and/or the unit controller 140 of FIG. 1-2 may be an exemplary computer system 700 described in FIG. 8.

Figure 8:
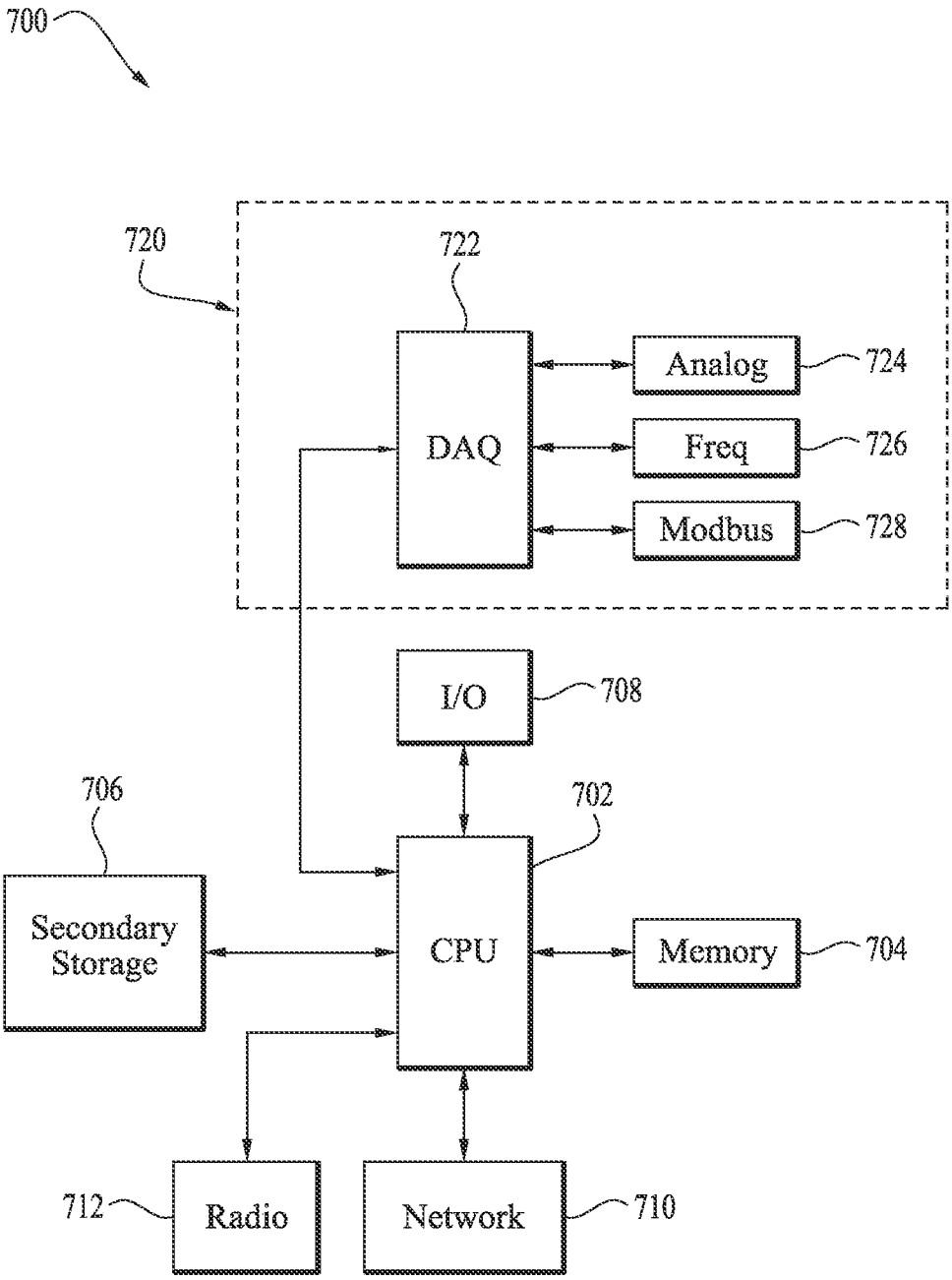
FIG. 8 is a block diagram of a computer system suitable for implementing one or more embodiments of the disclosure.

Turning now to FIG. 8, a computer system 700 suitable for implementing one or more embodiments of the unit controller, for example, unit controller 140, including without limitation any aspect of the computing system associated with the pumping systems and method of operation disclosed herein. The computer system 700 may be suitable for implementing one or more embodiments of a remote computer system, for example, a cloud computing system, a virtual network function (VNF) on a network slice of a cloud computing platform, and a plurality of user devices. The computer system 700 includes one or more processors 702 (which may be referred to as a central processor unit or CPU) that is in communication with memory 704, secondary storage 706, input output devices 708, and network devices 710. The computer system 700 may continuously monitor the state of the input devices and change the state of the output devices based on a plurality of programmed instructions. The programming instructions may comprise one or more applications retrieved from memory 704 for executing by the processor 702 in non-transitory memory within memory 704. The input output devices may comprise a Human Machine Interface with a display screen and the ability to receive conventional inputs from the service personnel such as push button, touch screen, keyboard, mouse, or any other such device or element that a service personnel may utilize to input a command to the computer system 700. The secondary storage 706 may comprise a solid state memory, a hard drive, or any other type of memory suitable for data storage. The secondary storage 706 may comprise removable memory storage devices such as solid state memory or removable memory media such as magnetic media and optical media, i.e., CD disks. The computer system 700 can communicate with various networks with the network devices 710 comprising wired networks, e.g., Ethernet or fiber optic communication, and short range wireless networks such as Wi-Fi (i.e., IEEE 802.11), Bluetooth, or other low power wireless signals such as ZigBee, Z-Wave, 6LoWPan, Thread, and WiFi-ah. The computer system 700 may include a long range radio transceiver 712 for communicating with mobile network providers.

In some embodiments, the computer system 700 may comprise a data acquisition (DAQ) card 720 for communication with one or more sensors. The DAQ card 720 may be a standalone system with a microprocessor 722, memory, and one or more applications executing in memory. The DAQ card 720, as illustrated, may be a card or a device within the computer system 700. In some embodiments, the DAQ card 720 may be combined with the input output device 708. The DAQ card 720 may receive one or more analog inputs 724, one or more frequency inputs 726, and one or more Modbus inputs 728. For example, the analog input 724 may include a volume sensor, e.g., a tank level sensor. For example, the frequency input 726 may include a flow meter, i.e., a fluid system flowrate sensor. For example, the Modbus input 728 may include a pressure transducer. The DAQ card 720 may convert the signals received via the analog input 724, the frequency input 726, and the Modbus input 728 into the corresponding sensor data. For example, the DAQ card 714 may convert a frequency input 726 from the flowrate sensor into flowrate data measured in gallons per minute (GPM).

In some embodiments, the computer system 700 can receive data indicative of the pumping operation from the pumping unit 110 and/or one or more sensors, e.g., torque sensor 251, fluid sensors 258, 262, 264, 266, a valve leakage sensor (e.g., vibration sensor, accelerometer, acoustic sensor), via the DAQ card 714 and/or the input output devices 708. The data may comprise periodic datasets, a constant stream of data, or combinations thereof. The data may be stored within memory 704, the secondary storage 706, a network location via the network devices 710, a remote storage location, or combinations thereof. In some embodiments, the computer system 700 can be communicatively coupled with a mobile communication network via the long range radio transceiver 712, e.g., a mobile network provider. In some embodiments, the computer system 700 can be communicatively coupled to a cloud based network location, e.g., a virtual computer system on a mobile network. In some embodiments, the computer system 700 can transmit/receive data and/or instructions from the cloud based network locations.

Additional Disclosure

The following are non-limiting, specific embodiments in accordance with the present disclosure:

A first embodiment, which is a pumping system, comprising: a pump fluid end comprising a plurality of pump chambers, each pump chamber comprising a bore having a reciprocatable plunger disposed therein, a suction valve, and a discharge valve; a prime mover mechanically coupled to the fluid end [by a drivetrain] and configured to reciprocate the plungers; and a controller communicatively coupled to the prime mover, the fluid end, or both and configured to alert a user (e.g., sound an alarm) re a pump malfunction, initiate corrective action of the pump malfunction, or both in response to: (a) an indication of torque reversal during operation of the pumping system, (b) an indication of negative flow rate from the pump during operation of the pumping system, (c) an indication of leakage of (i) a single discharge valve in a 3-plunger pump or (ii) discharge valves associated with two plungers in adjacent/successive firing order (e.g., firing order is the sequential order in which the plungers are reciprocated from a fully retracted position at the end of a suction stroke to a fully extended position at the end of a discharge stroke), or (d) any combination of (a)-(c).

A second embodiment, which is the pumping system of the first embodiment, wherein the indication of torque reversal comprises a negative torque value detected by a torque monitoring system comprising a torque sensor coupled to the pump fluid end or prime mover and provided to the controller during operation of the pumping system to pump a fluid.

A third embodiment, which is the pumping system of the second embodiment, wherein the negative torque value detected by the torque monitoring system is associated with a drivetrain component mechanically coupling the prime mover to the fluid end.

A fourth embodiment, which is the pumping system of the third embodiment, wherein the drivetrain component is a rotating drive shaft, a rotating crankshaft, or a rotating component (e.g., gear) of a transmission or gear box.

A fifth embodiment, which is the pumping system of fourth embodiment, wherein the negative torque value is a function of rotational angle of the crankshaft as the crankshaft rotates 360 degrees during reciprocation (e.g., a suction and discharge stroke) of the plunger.

A sixth embodiment, which is the pumping system of the fifth embodiment, wherein the negative torque value repeats during each successive 360-degree rotation of the crankshaft.

A seventh embodiment,t which is the pumping system of the sixth embodiment, wherein the negative torque value is in a range of less than zero to about −5000 lb-ft. at a pump operating pressure of about 8000 psi.

An eighth embodiment, which is the pumping system of the first embodiment, wherein the indication of negative flow rate from the pump comprises a negative flow rate value detected by a flow rate monitoring system comprising a flow rate sensor coupled to the pump fluid end or prime mover and provided to the controller during operation of the pumping system to pump a fluid.

A ninth embodiment, which is the pumping system of eighth embodiment, wherein the negative flow rate value is a function of rotational angle of the crankshaft as the crankshaft rotates 360 degrees during reciprocation (e.g., a suction and discharge stroke) of the plunger.

A tenth embodiment, which is the pumping system of the ninth embodiment, wherein the negative flow rate value repeats during each successive 360-degree rotation of the crankshaft.

An eleventh embodiment, which is the pumping system of the tenth embodiment, wherein the negative flow rate value is in a range of less than zero to about −10 bpm at a pump operating pressure of about 8000 psi.

A twelfth embodiment, which is the pumping system of the first embodiment, wherein the indication of leakage of a single discharge valve in a 3-plunger pump comprises the condition of each discharge valve in the 3-plunger pump detected by valve-leakage monitoring system comprising a valve-leakage sensor (e.g., vibration sensor or accelerometer) coupled to the pump fluid end or prime mover and provided to the controller during operation of the pumping system to pump a fluid.

A thirteenth embodiment, which is the pumping system of twelfth embodiment, wherein indication of leakage is a result of the discharge valve being propped open by debris in the fluid during a discharge stroke of the plunger (e.g., the debris obstructing/preventing complete closure of the discharge valve).

A fourteenth embodiment, which is the pumping system of first embodiment, wherein the indication of leakage of discharge valves associated with two plungers in adjacent/successive firing order comprises the condition of each discharge valve in a 5-plunger pump detected by valve-leakage monitoring system comprising a valve-leakage sensor (e.g., vibration sensor or accelerometer) coupled to the pump fluid end or prime mover and provided to the controller during operation of the pumping system to pump a fluid.

A fifteenth embodiment, which is the pumping system of fourteenth embodiment, wherein indication of leakage is a result of the discharge valves being propped open by debris in the fluid during a discharge stroke of the plunger (e.g., the debris obstructing/preventing complete closure of the discharge valve).

A sixteenth embodiment, which is the pumping system of any of first through fifteenth embodiments, wherein the initiation of corrective action by the controller comprises slowing or halting reciprocation of the plurality of plungers of the malfunctioning pump.

A seventeenth embodiment, which is the pumping system of sixteenth embodiment, wherein slowing reciprocation of the plurality of plungers further comprise slowing a speed of the prime mover (e.g., electric motor or combustion engine) and wherein halting reciprocation of the plurality of plungers further comprise shutting down the pump, turning the pump off, mechanically disconnecting or decoupling the fluid end from the power end, or placing the pump in a neutral via a gearbox or transmission.

An eighteenth embodiment, which is the pumping system of sixteenth or seventeenth embodiments, wherein the initiation of corrective action by the controller comprises, concurrent with or subsequent to slowing or halting reciprocation of the plurality of plungers of the malfunctioning pump, (i) starting one or more backup pumps to pump the fluid, (ii) increasing pumping rate of one or more additional pumps pumping the fluid, or (iii) both (i) and (ii).

A nineteenth embodiment, which is a fracturing spread comprising plurality of the pumping systems of any of the first through eighteenth embodiments in fluid communication with a well via a pumping and piping manifold. As used herein, the term "pumping and piping manifold" or "piping and manifold system" can mean a zone of piping and equipment providing a fluid path to and from equipment and a well (e.g., wellhead), and capable of forming an isolated or a closed (test) system subject to pressurized fluid and pressure testing. This zone can include the discharges from one or more pumps, one or more manifolds, and piping to one or more valves isolating one or more respective wellheads. In the field, this zone may be referred to as a "frac-iron" or "frac-iron configuration" subject to high pressures during operations. Although the term "iron" may be utilized to describe the equipment and piping, such as the frac-iron, the equipment may be made from iron or any other suitable material other than iron depending on the type of operation A twentieth embodiment, which is a method of hydraulic fracturing a subterranean formation penetrated by a wellbore, comprising pumping, with the fracturing spread of the nineteenth embodiment, a fracturing fluid into the subterranean formation via the wellbore at a pressure effective to hydraulically fracture the subterranean formation.

A twenty-first embodiment, which is a pump system, comprising: a pump fluid end comprising a plurality of pump chambers, each pump chamber comprising a bore having a reciprocatable plunger disposed therein, a suction valve, and a discharge valve; a prime mover mechanically coupled to the fluid end [by a drivetrain] and configured to reciprocate the plungers; and a controller communicatively coupled to the prime mover, the unit controller comprising a processor and a non-transitory memory and configured to (execute instructions stored in the memory to perform a method comprising): control a pumping operation of the pump system via control of the prime mover; receive a data stream of one or more parameters from the pumping system indicative of the pumping operation, wherein the parameters comprise: (a) a torque value from a torque sensor of a torque monitoring system coupled to the pump fluid end or prime mover during operation of the pumping system, (b) the condition of each discharge valve in a 5-plunger pump from a valve-leakage sensor of a valve-leakage monitoring system coupled to the pump fluid end or prime mover during operation of the pumping system, (c) the condition of each discharge valve in a 3-plunger pump from a valve-leakage sensor of a valve-leakage monitoring system coupled to the pump fluid end or prime mover during operation of the pumping system, (d) a flow rate value for the pump from a flow rate sensor of a flow rate monitoring system coupled to the pump fluid end or prime mover during operation of the pumping system, or (e) any combination of (a)-(d); compare the one or more parameters (a)-(d) to a corresponding threshold condition (a)-(d) associated with each parameter, wherein threshold condition (a) is an indication of negative torque, threshold condition (b) is an indication of the leakage of discharge valves associated with two plungers in adjacent/successive firing order of the 5-plunger pump (e.g., firing order is the sequential order in which the plungers are reciprocated from a fully retracted position at the end of a suction stroke to a fully extended position at the end of a discharge stroke), threshold condition (c) is an indication of leakage of a discharge valve associated with a single plunger in the 3-plunger pump; and threshold condition (d) is an indication of negative flow rate from the pump; and modify the pumping operation in response to the one or more parameters not meeting the threshold condition (a), (b), (c), (d), or any combination thereof.

A twenty-second embodiment, which is a method of servicing a wellbore penetrating a subterranean formation located at a wellsite (e.g., hydraulic fracturing the subterranean formation), comprising: transporting pumping equipment and a controller to the wellsite and assembling same; starting and controlling a pumping job by a controller in communication with the pumping equipment; receiving by the controller a data stream/set containing measurements of torque, flow rate, discharge valve leakage, or combinations thereof associated with pumping equipment during the pumping job; comparing by the controller the measurements of torque, flow rate, discharge valve leakage, or combinations thereof with a threshold condition thereof; identifying by the controller one or more of the measurements of torque, flow rate, discharge valve leakage, or combinations thereof that deviate from the threshold condition thereof; and responsive to identification of the deviation from the threshold condition, modifying by the controller the pumping operation, for example by reducing the flow rate or halting the pumping operation to mitigate damage to the pumping equipment.

A twenty-third embodiment, which is a method of servicing a wellbore penetrating a subterranean formation located at a wellsite (e.g., hydraulic fracturing the subterranean formation), comprising: transporting pumping equipment and a controller to the wellsite and assembling same; starting and controlling a pumping job by a controller in communication with the pumping equipment; monitoring by the controller for one or more of the following conditions: (a) an indication of torque reversal during operation of the pumping system, (b) an indication of negative flow rate from the pump during operation of the pumping system, (c) an indication of leakage of (i) a single discharge valve in a 3-plunger pump or (ii) discharge valves associated with two plungers in adjacent/successive firing order (e.g., firing order is the sequential order in which the plungers are reciprocated from a fully retracted position at the end of a suction stroke to a fully extended position at the end of a discharge stroke), or (d) any combination of (a)-(c); responsive to a positive indication of any of conditions (a)-(d), modifying by the controller the pumping operation, for example by reducing the flow rate or halting the pumping operation to mitigate damage to the pumping equipment.

A twenty-fourth embodiment, which is the system or method of any preceding embodiment, wherein the discharge valve is leaking due to debris trapped in the discharge valve, wherein the discharge valve is leaking due to erosion of the value (e.g., from pumping abrasive proppant-laden fracturing fluid), wherein the discharge valve is leaking due to damage to one or more components of the discharge valve (e.g., seat, poppet, spring, etc.), or combinations thereof.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru-Rl), wherein k is a variable ranging from 1 percent to 100 percent with a 1 percent increment, i.e., k is 1 percent, 2 percent, 3 percent, 4 percent, 5 percent, 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A pumping system, comprising:

a pump comprising:

a pump fluid end comprising a plurality of pump chambers, each pump chamber comprising a bore having a reciprocatable plunger disposed therein, a suction valve, and a discharge valve; and a prime mover mechanically coupled to a crankshaft configured to reciprocate the plungers;

a torque monitoring system configured to monitor torque of the pump;

one or more additional pumps; and a controller configured to increase pumping rate of the one or more additional pumps, in response to detecting the torque changing from positive to negative or from negative to positive during cyclic rotation of the crankshaft.

2. The pumping system of claim 1, wherein the torque monitoring system comprising a torque sensor coupled to the pump fluid end or the prime mover.

3. The pumping system of claim 2, wherein the negative torque detected by the torque monitoring system is associated with the crankshaft.

4. The pumping system of claim 3, further comprising a rotating drive shaft mechanically coupled to the prime mover.

5. The pumping system of claim 4, wherein the negative torque is a function of rotational angle of the crankshaft as the crankshaft rotates 360 degrees during reciprocation of the plunger.

6. The pumping system of claim 5, further comprising a transmission mechanically coupled to the prime mover.

7. The pumping system of claim 6, wherein the negative torque is in a range of less than zero to about −5000 lb-ft. at a pump operating pressure of about 8000 psi.

8. The pumping system of claim 1, wherein the controller is further configured to detect a negative flow by using a flow rate monitoring system comprising a flow rate sensor coupled to the pump fluid end or the prime mover.

9. The pumping system of claim 8, wherein the negative flow is a function of rotational angle of the crankshaft as the crankshaft rotates 360 degrees during reciprocation of the plunger.

10. The pumping system of claim 9, further comprising a gear box mechanically coupled to the prime mover.

11. The pumping system of claim 10, wherein the negative flow is in a range of less than zero to about −10 bpm at a pump operating pressure of about 8000 psi.

12. The pumping system of claim 1, wherein the controller is further configured to slow or halt reciprocation of the plurality of plungers, in response to the torque changing from positive to negative or from negative to positive during the cyclic rotation of the crankshaft.

13. The pumping system of claim 12, wherein the controller is further configured to slow or halt reciprocation of the plurality of plungers by slowing a speed of the prime mover or shutting down the pumping system, turning the pumping system off, mechanically disconnecting or decoupling the fluid end from a power end of the pumping system, or placing the pumping system in a neutral via a gearbox or transmission.

14. The pumping system of claim 13, wherein the controller is further configured to start one or more backup pumps, in response to the torque changing from positive to negative or from negative to positive during the cyclic rotation of the crankshaft.

15. The pumping system of claim 1, wherein the controller is further configured to generate an alert of a malfunction of the pumping system, initiate a corrective action for the malfunction, or both, in response to detecting a leakage of a single discharge valve of the pumping system.

16. The pumping system of claim 15, wherein the controller is further configured to detect the leakage by using a valve-leakage monitoring system comprising a valve-leakage sensor coupled to the pump fluid end or the prime mover.

17. The pumping system of claim 16, wherein the leakage is a result of the discharge valve being propped open by debris.

18. The pumping system of claim 1, wherein the controller is further configured to generate an alert of a malfunction of the pumping system, initiate a corrective action for the malfunction, or both, in response to detecting a leakage of discharge valves associated with two plungers, of the pumping system, in adjacent firing order.

19. The pumping system of claim 18, wherein the controller is further configured to detect the leakage by using a valve-leakage monitoring system comprising a valve-leakage sensor coupled to the pump fluid end or the prime mover.

20. The pumping system of claim 19, wherein the leakage is a result of the discharge valves being propped open by debris.

* * * * *